US009463908B2

(12) United States Patent
Fellin et al.

(10) Patent No.: US 9,463,908 B2
(45) **Date of Patent: *Oct. 11, 2016**

(54) FOOD POUCH CONTAINER

(71) Applicants: Timothy B. Fellin, Manhattan Beach, CA (US); Jennifer Fellin, Manhattan Beach, CA (US)

(72) Inventors: Timothy B. Fellin, Manhattan Beach, CA (US); Jennifer Fellin, Manhattan Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/872,157

(22) Filed: Oct. 1, 2015

(65) Prior Publication Data

US 2016/0023811 A1 Jan. 28, 2016

Related U.S. Application Data

(63) Continuation of application No. PCT/US2015/011954, filed on Jan. 20, 2015, which is a continuation of application No. 14/340,778, filed on Jul. 25, 2014, now Pat. No. 9,085,398, which is a continuation of application No. 14/340,547, filed on Jul. 24, 2014.

(60) Provisional application No. 61/929,206, filed on Jan. 20, 2014.

(51) Int. Cl.

| | |
|---|---|
| ***B65D 35/56*** | (2006.01) |
| ***B65D 77/04*** | (2006.01) |
| ***B65D 43/22*** | (2006.01) |
| ***B65D 77/06*** | (2006.01) |
| ***B65D 25/04*** | (2006.01) |

(Continued)

(52) U.S. Cl.

CPC ..... *B65D 35/56* (2013.01); *A47G 19/18* (2013.01); *B65D 11/20* (2013.01); *B65D 25/04* (2013.01); *B65D 25/10* (2013.01); *B65D 25/28* (2013.01); *B65D 35/10* (2013.01); *B65D 35/30* (2013.01); *B65D 43/22* (2013.01); *B65D 77/044* (2013.01); *B65D 77/06* (2013.01); *B65D 83/0011* (2013.01)

(58) Field of Classification Search

CPC ..... B65D 35/56; B65D 35/10; B65D 35/30; B65D 25/28; B65D 25/10; B65D 25/04; B65D 83/0011; B65D 11/20; B65D 77/06; B65D 43/22; B65D 77/044; A47G 19/18

USPC ..... 220/495.03, 505, 520–522, 551, 552, 220/554–557; 222/206, 213, 95, 105, 183

See application file for complete search history.

(56) References Cited

U.S. PATENT DOCUMENTS 2,024,493 A * 12/1935 Weinrich ..... F25D 23/025 126/194

2,558,124 A 6/1951 Burden (Continued)

OTHER PUBLICATIONS

"EasyPouch Independence", [Online]. Retrieved from the Internet: <http.www.amazon.com>.

(Continued)

*Primary Examiner* — Robert J Hicks
*Assistant Examiner* — Kareen Thomas
(74) *Attorney, Agent, or Firm* — David A. Belasco; Belasco Jacobs & Townslety, LLP

(57) ABSTRACT

Disclosed herein are food pouch containers comprising a body having an interior cavity; a door; a hole; and a surface for contouring the bottom of the food pouch. Also disclosed are food pouch containers comprising a back portion having an interior cavity; a cover; a hole; means for contouring the food pouch from a bottom thereof; and means for contouring the food pouch from at least a side thereof. In some embodiments, a surface divides the interior cavity into an upper cavity and the lower cavity.

38 Claims, 30 Drawing Sheets

(51) Int. Cl.

| | |
|---|---|
| ***B65D 25/10*** | (2006.01) |
| ***B65D 6/00*** | (2006.01) |
| ***B65D 83/00*** | (2006.01) |
| ***A47G 19/18*** | (2006.01) |
| ***B65D 25/28*** | (2006.01) |
| ***B65D 35/10*** | (2006.01) |
| ***B65D 35/30*** | (2006.01) |

(56) References Cited

U.S. PATENT DOCUMENTS

| | | | | |
|---|---|---|---|---|
| 2,864,367 | A | 12/1958 | Mende | |
| 4,890,741 | A | 1/1990 | Edelstein | |
| 5,337,924 | A | 8/1994 | Dickie | |
| 5,377,869 | A | 1/1995 | Weiss | |
| 5,474,212 | A | 12/1995 | Ichikawa | |
| 5,730,327 | A | 3/1998 | Stern | |
| 6,076,698 | A | 6/2000 | Magidson | |
| 6,142,344 | A | 11/2000 | Kai | |
| 6,510,965 | B1 | 1/2003 | Decottignies | |
| 6,574,985 | B2 | 6/2003 | Fiore | |
| 6,619,505 | B1 | 9/2003 | Decottignies | |
| 8,430,262 | B2 | 4/2013 | Corbett | |
| 8,701,905 | B2 * | 4/2014 | Warner | B65D 1/0215 215/12.1 |
| 8,714,407 | B2 | 5/2014 | Frank | |
| 8,875,929 | B1 * | 11/2014 | Forney | A47J 43/00 220/495.03 |
| 2012/0168461 | A1 | 7/2012 | Topits | |

OTHER PUBLICATIONS

"Fisher-Price Tote Along Pouch", [Online]. Retrieved from the Internet: <http.www.amazon.com>.

"International Application Serial No. PCT/US2015/011959, Written Opinion mailed Mar. 31, 2015", 5 pgs.

* cited by examiner

FOOD POUCH CONTAINER

RELATED APPLICATIONS

The present application is a continuation of PCT Application Serial No. PCT/US2015/011954, filed Jan. 20, 2015 entitled "Food Pouch Container", which claims priority to currently pending U.S. patent application Ser. No. 14/340,778 filed Jul. 25, 2014 entitled "Food Pouch Container", which is a continuation of currently pending U.S. patent application Ser. No. 14/340,547 filed Jul. 24, 2014 entitled "Food Pouch Container", which claims priority to U.S. Provisional Application Ser. No. 61/929,206 filed on Jan. 20, 2014 entitled "Food Pouch Container", by Timothy Fellin et al., the entire disclosure of all of the above applications are incorporated by reference in their entirety, including their drawings.

FIELD OF THE INVENTION

The present invention is in the field of food containers, and in particular in the field of containers for food pouches.

BACKGROUND OF THE DISCLOSURE

Recently, there has been an increased growth in the use and marketing of food pouches, also referred to as stand-up pouches, especially for use with baby food. The food pouches are easy to use for the parents and the children can suck the food out of the pouch. The use of the food pouch eliminates the need for a glass baby food jar, and the need to spoon feed the food to the infant or toddler, thereby reducing the mess that is often accompanied when one is feeding a child. The food pouches may vary in shape, size, mouthpiece or nozzle, cap or top, and orientation of mouthpiece or nozzle.

However, the food pouches themselves can create mess as the flow of food through the opening of the food pouch is not always controlled. Therefore, when the child squeezes the food pouch, the food squirts from the top opening and can soil the child's clothing or surroundings. Thus, there is a need in the art to retain the convenience of the food pouch but reduce or prevent the accompanying mess that the use of the food pouch produces.

SUMMARY OF THE INVENTION

Disclosed herein are food pouch containers comprising a body having an interior cavity; a door; a hole; and a surface for contouring the bottom of the food pouch. Also disclosed are food pouch containers comprising a body having an interior cavity; a door; a hole; at least one side pinch; and a surface dividing the interior cavity of the body into an upper cavity and a lower cavity. Also disclosed are food pouch containers comprising a back portion having an interior cavity; a cover; a hole; means for contouring the food pouch from a bottom thereof; and means for contouring the food pouch from at least a side thereof. Also disclosed are food pouch containers comprising a substantially rigid body configured to substantially encapsulate the pouch and sized for nesting of the pouch inside the body; the body having an opening for the mouthpiece to protrude outside the body; and the body being contoured to change the pouch to a bulbous shape, thereby enabling the soft food to be more easily emptied out of the pouch. Also disclosed are food pouch containers comprising a back portion having an interior cavity and a first perimeter groove; a front portion with a second perimeter groove; a top hole; at least one side pinch for preventing the food pouch from collapsing while its contents are being emptied; and a cantilever extending from the back portion into the front portion, thereby dividing the interior cavity of the food pouch container into an upper cavity and a lower cavity, wherein the back portion and the front portion are attached via a hinge at the bottom of the container, and wherein the first and second perimeter grooves interlock upon closing the container.

DETAILED DESCRIPTION OF THE EMBODIMENTS

Disclosed herein are containers for holding a food pouch. The interior of the containers disclosed herein comprise elements on the sides and the bottom that are designed to contour the shape of the food pouch in such a way as to allow the food to easily be accessible to the user, e.g., a child, regardless of the amount of food left in the pouch. Some embodiments of the presently disclosed containers prevent the area around the neck of the pouch to collapse and create a vacuum seal.

The various embodiments of the presently disclosed containers are now described in view of the drawings.

Figure 1:
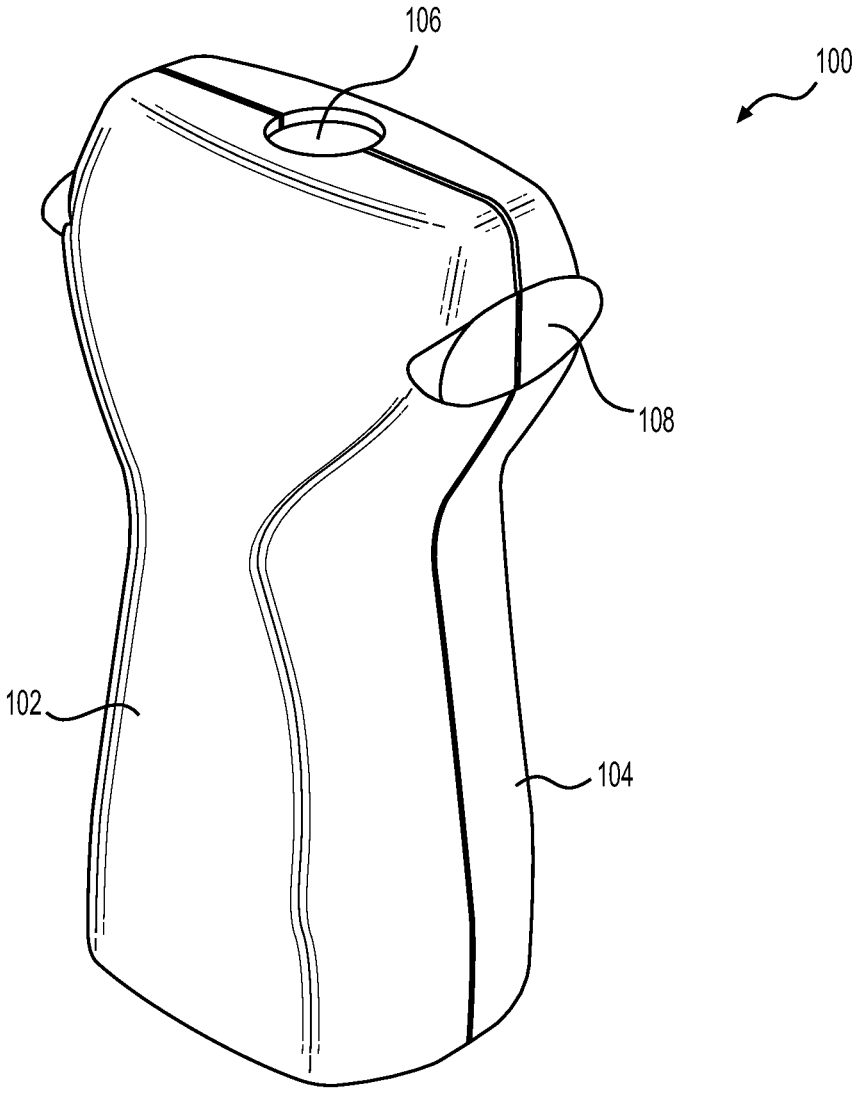
FIG. 1 illustrates an embodiment of the food pouch container disclosed herein in its closed configuration.

FIG. 1 shows an embodiment of the presently disclosed container 100 in its closed configuration. The container 100 comprises a body, having a front portion 102 and a back portion 104. In some embodiments, the front portion 102 may alternatively be referred to as a door, cover, cap, or lid, and the back portion 104 may alternatively be referred to as a body. The container 100 also comprises a top opening 106, from which the nozzle or mouthpiece of a food pouch protrudes once the food pouch is placed inside the container 100. In some embodiments, the top opening 106 may alternatively be referred to as a hole, opening, or orifice. In some embodiments, tabs 108 are placed on either side of the container 100, which are configured to ease the opening of the container 100 so that a new food pouch can be placed therein or a used food pouch be removed therefrom.

The container 100 is preferably constructed of a rigid, child-safe material, such as plastic, wood, shatterproof glass, metal, or other rigid material, which holds the food pouch and preferably prevents a consumer from expelling the contents of the food pouch by squeezing. The container 100 may be opaque, semi-transparent, or transparent, in order to allow the contents within the container 100 to be seen.

Figure 2:
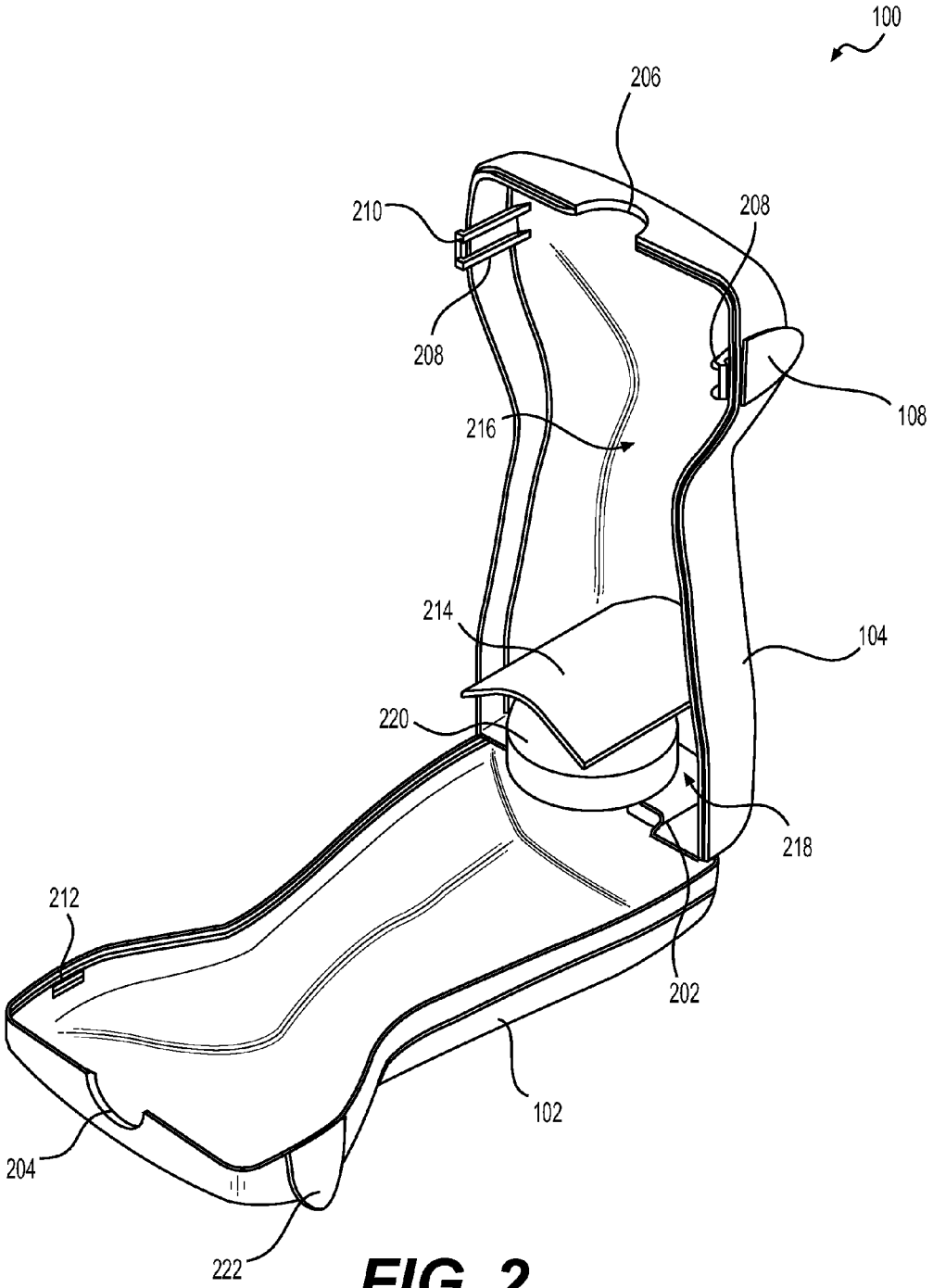
FIG. 2 illustrates an embodiment of the food pouch container disclosed herein in its open configuration.

FIG. 2 shows an embodiment of the presently disclosed container 100 in its open configuration. In some embodiments, for example the one shown in FIG. 2, the front portion 102 and the back portion 104 are attached together at the bottom of the container 100, i.e., the side opposite of the top opening 106, by a hinge 202, which is described more fully below. In other embodiments, when the container 100 is opened, the front portion 102 and the back portion 104 become separated.

In some embodiments, for example that shown in FIG. 2, the top opening 106 comprises of two semicircle sections. One semicircle portion 204 is cut into the front portion 102, whereas another semicircle 206 is cut into the back portion 104. In some embodiments, the semicircles 204 and 206 are of the same size, i.e., they each define an arc of 180°. In other embodiments, and primarily depending on the thickness of the top edges of the front portion 102 and the back portion 104, the semicircles 204 and 206 may be of a different size. For example, one of the semicircles 204,206 defines an arc >180°, while the other of the semicircles 204,206 defines an arc <180°.

In some embodiments (not shown), the top opening 106 is in the shape of a square, a rectangle, a rhombus, a parallelogram, a triangle, a trapezoid, or another geometric shape. In these embodiments, the front portion 102 and the back portion 104 comprise the two halves of the top opening 106, which when the container 100 is closed, the two halves form one of the aforementioned shapes. Thus, in these embodiments, the front portion 102 and the back portion 104 do not comprise semicircles, but comprise the halves of the top opening 106.

In some embodiments, once the container 100 is closed, the front portion 102 and the back portion 104 are held together by at least one latch. The latch may be placed anywhere along the perimeter of the container 100. In some embodiments, the latch is along the internal perimeter of the container 100, whereas in other embodiments, the latch is along the external perimeter of the container 100. In some embodiments, the latch is towards the top of the container 100. In these embodiments, the bottom of the container 100 comprises a hinge or other mechanism, such as a tab and slot, or a friction lock mechanism. In other embodiments, the latch is towards the bottom of the container 100. In these embodiments, the top of the container 100 comprises a hinge or other mechanism, such as a tab and slot, or a friction lock mechanism. In some embodiments, the latch is on one of the sides of the container 100. In some embodiments, a side of the container 100 comprises a hinge or other mechanism.

In some embodiments, for example that shown in FIG. 2, the back portion 104 comprises two latches 208, located at either side of the upper part of the back portion 104. In some embodiments, each latch 208 comprises a lip 210 (also referred to as a raised member), which points outward. The front portion 102 comprises corresponding indents 212. When the container 100 is closed, the lip 210 of the latch 208 catches inside the indent 212 and causes the front portion 102 and the back portion 104 to remain connected. In other embodiments, the latch 208 engages a corresponding portion in the front portion 102 to create a friction lock. In the embodiment shown in FIG. 2, the lip 210 and the indent 212 are shown as lines. In other embodiments, the lip 210 and the indent 212 may have another geometric shape, for example a circle, a semicircle, a hemisphere, a square, a rectangle, a rhombus, a parallelogram, a triangle, or a trapezoid.

In certain embodiments, tabs 108 are placed on the outside of the back portion 104, in a place corresponding to the latches 208. When the tabs 108 are pressed, the latches 208, and consequently the lips 210, are pushed to the interior cavity of the back portion 104. If the latches 208 are engaged with the indents 212, then pressing on the tabs 108 releases the lips 210 from the indents 212. The front portion 102 and the back portion 104 can then be easily separated. Tab 222 is provided on the front portion 102 to provide additional friction for when a user chooses to open the container 100. Thus, in these embodiments, to open the container 100, a user can hold the back portion 104 by the tabs 108 and the front portion 102 by the tabs 222. The user then exerts pressure on the tabs 108 to release the latches 208 from the indents 212. Then the user pulls the tabs 108 away from the tabs 222.

In some embodiments (not shown), where the latches 208 form a friction lock with the front portion 102, the tabs 108 solely provide a friction hold for the user, similar to the tabs 222.

While the latch mechanisms here have been described with the reference to their placement on either the front portion 102 or the back portion 104, the skilled artisan recognizes that the arrangement can easily be reversed. The reversed arrangement is specifically contemplated.

In some embodiments, a surface 214 divides the interior cavity of the back portion 104 into an upper cavity 216 and a lower cavity 218. In some embodiments, for example that shown in FIG. 2, the surface 214 is a cantilever, whereas in other embodiments, the surface 214 is a shelf. In certain embodiments, the surface 214 is arced, whereas in other embodiments, the surface 214 is flat. In some embodiments, the surface 214 is fixed in place. In other embodiments, the position of the surface 214 is changed upward or downward, as described more fully below. In some embodiments, the upper cavity 216 is configured to receive a food pouch (not shown). In certain embodiments, the lower cavity 218 is configured to optionally hold the cap 220 of the food pouch. This embodiment is illustrated in FIG. 2.

Throughout the present disclosure and the claims, the direction "up," "top," or "upper" refers towards the location where the mouthpiece of a food pouch fits into the container 100. The direction "down," "lower," or "bottom" refers towards the location where the bottom of the food pouch fits into the container 100. Thus, for example, the top hole 106 is at the top and the surface 214 is at the bottom with respect to the top hole. In other words, the surface 214 is "lower" than the top hole 106.

Throughout the present disclosure, the "front" and "back" refer to the location of the surface 214. Thus, whichever portion that comprises the surface 214 is considered the "back" portion, regardless of how the container 100 is held by the user.

Figure 3A:
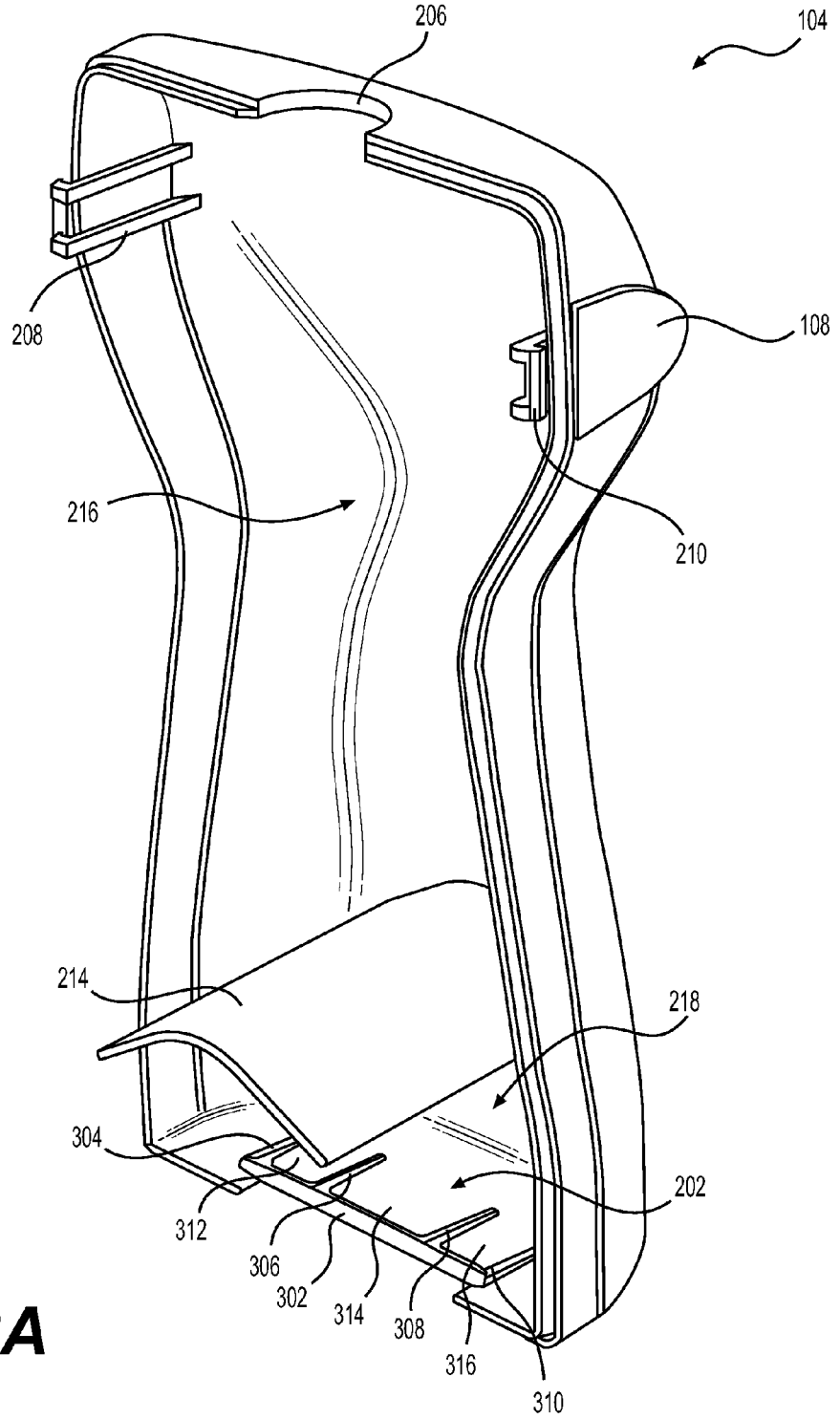
FIG. 3A illustrates the view of the interior of an embodiment of the back portion of the food pouch container disclosed herein.
Figure 3B:
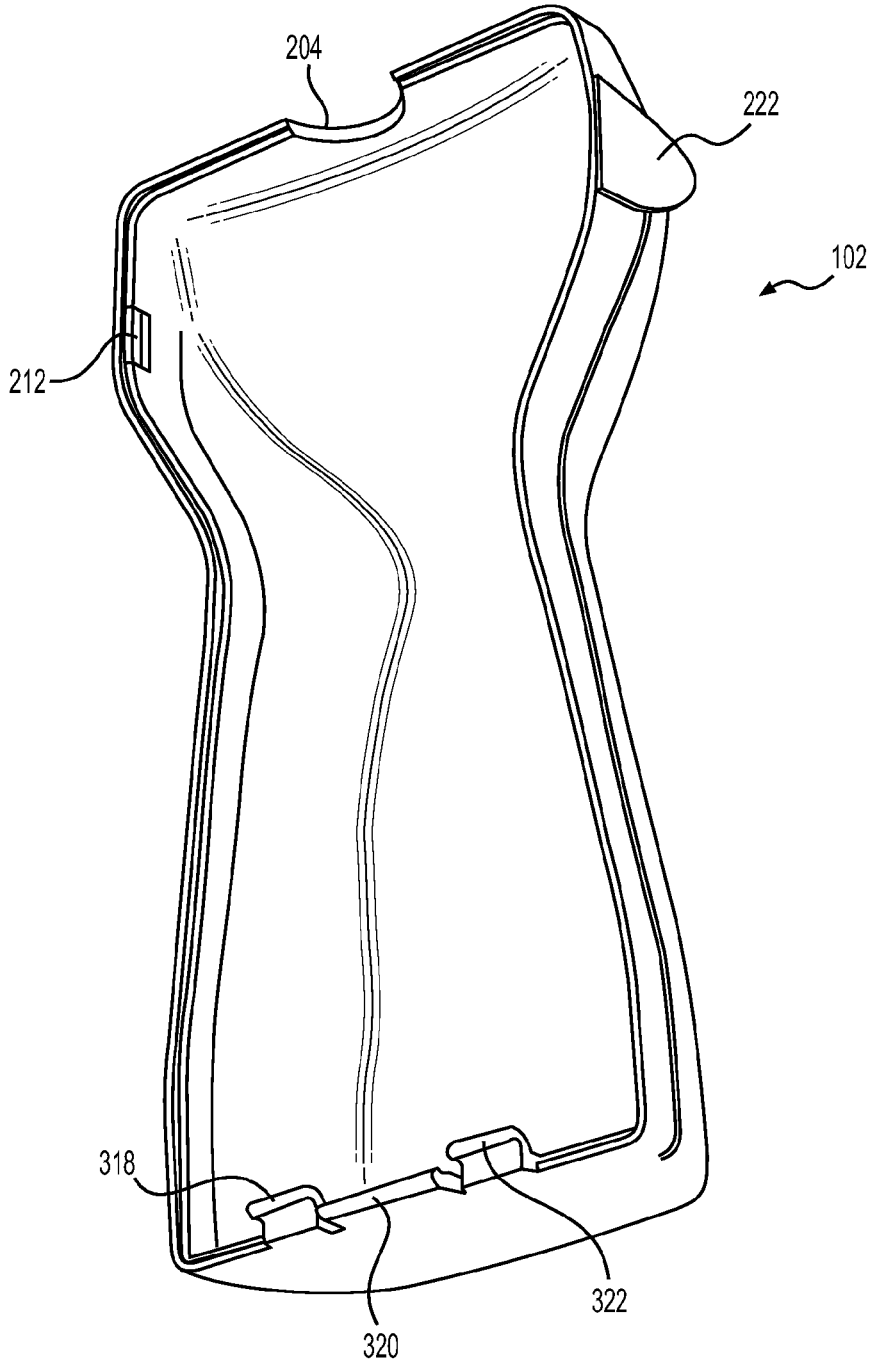
FIG. 3B illustrates the view of the interior of an embodiment of the front portion of the food pouch container disclosed herein.

FIG. 3A provides a clearer view of the interior of the back portion 104, without the presence of the front portion 102 or the cap 220. The back portion of the hinge 202 is also illustrated. FIG. 3B provides a clearer view of the interior of the front portion 102, without the presence of the back portion 104.

In FIG. 3A, the back of the hinge 202 on the back portion 104 comprises a bar 302. Ridges 304,306,308,310 divide the hinge 202 portion into three areas 312, 314, and 316. The front edge of each of the areas 312,314,316 is open. The front of the hinge 202 on the front portion 102 of FIG. 3B comprises three curved members. The outer members 318 and 322 are arced downward whereas the central member 320 is arced upward. When the front portion 102 and the back portion 104 are joined together, the outer members 318 and 322 catch the bar 302 in front of areas 316 and 312, respectively, such that the bar 302 is placed under the curved members 318 and 322. Simultaneously, the central member 320 catches the bar 302 in front of area 314 such that the bar 302 is placed above the curved member 320. Thus, a hinge is formed.

Figure 3C:
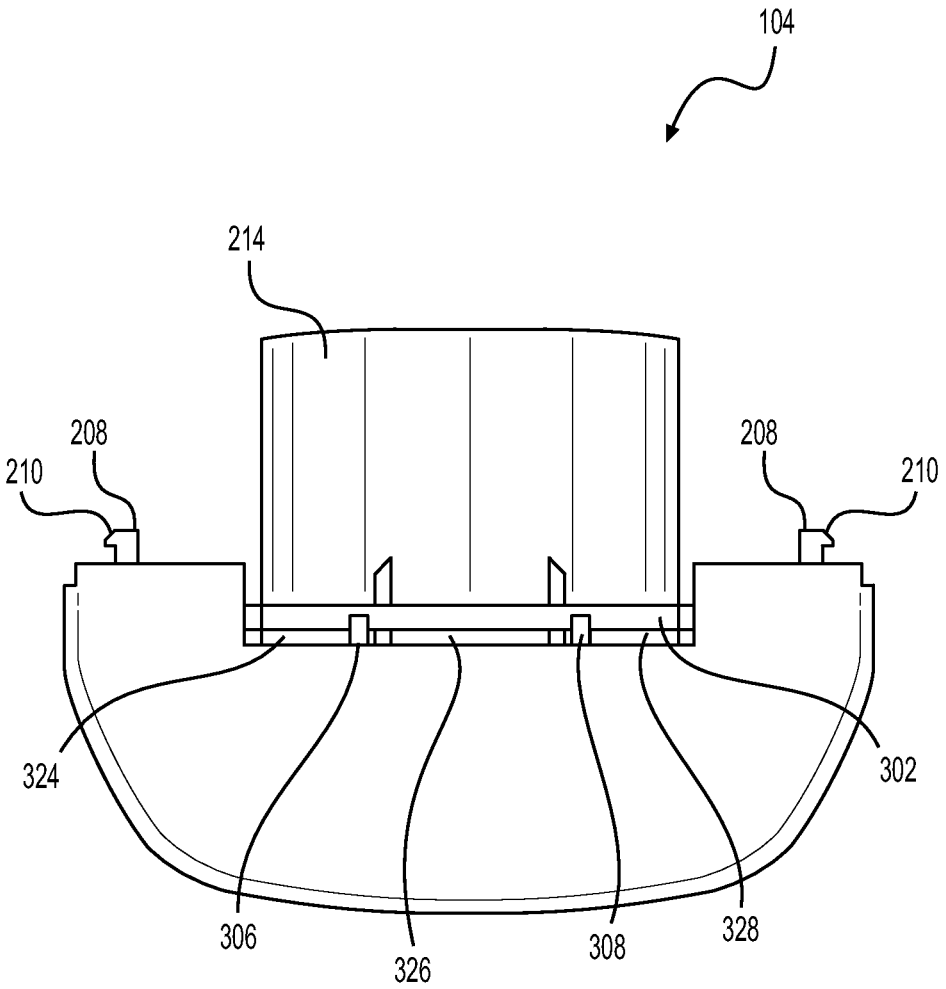
FIG. 3C illustrates the bottom view of an embodiment of the back portion of the food pouch container disclosed herein.

FIG. 3C is a bottom view of the back portion 104 showing the position of the bar 302, the ridges 306,308 and the openings 324, 326, and 328 in front of the areas 312, 314, and 316, respectively.

Other methods of forming a hinge are known in the art and are contemplated herein. For example, in some embodiments, the front portion 102 comprises a plurality of semicircular members that catch the bar 302, thus forming a hinge. In other embodiments, more or fewer curved members are placed on the front portion 102. In other embodiments, the curved members 318,320,322 are placed on the back portion 104, whereas the bar 302 is placed on the front portion 102. Any other configuration that allows for a hinge to be formed is contemplated.

In some embodiments, the front view of the container 100 comprises a generally rectangular shape. In other embodiments, the front view shape of the container 100 is square. In other embodiments, the front view shape of the container 100 comprises another geometric shape, for example a circle, a triangle, a trapezoid, and the like.

Figure 4:
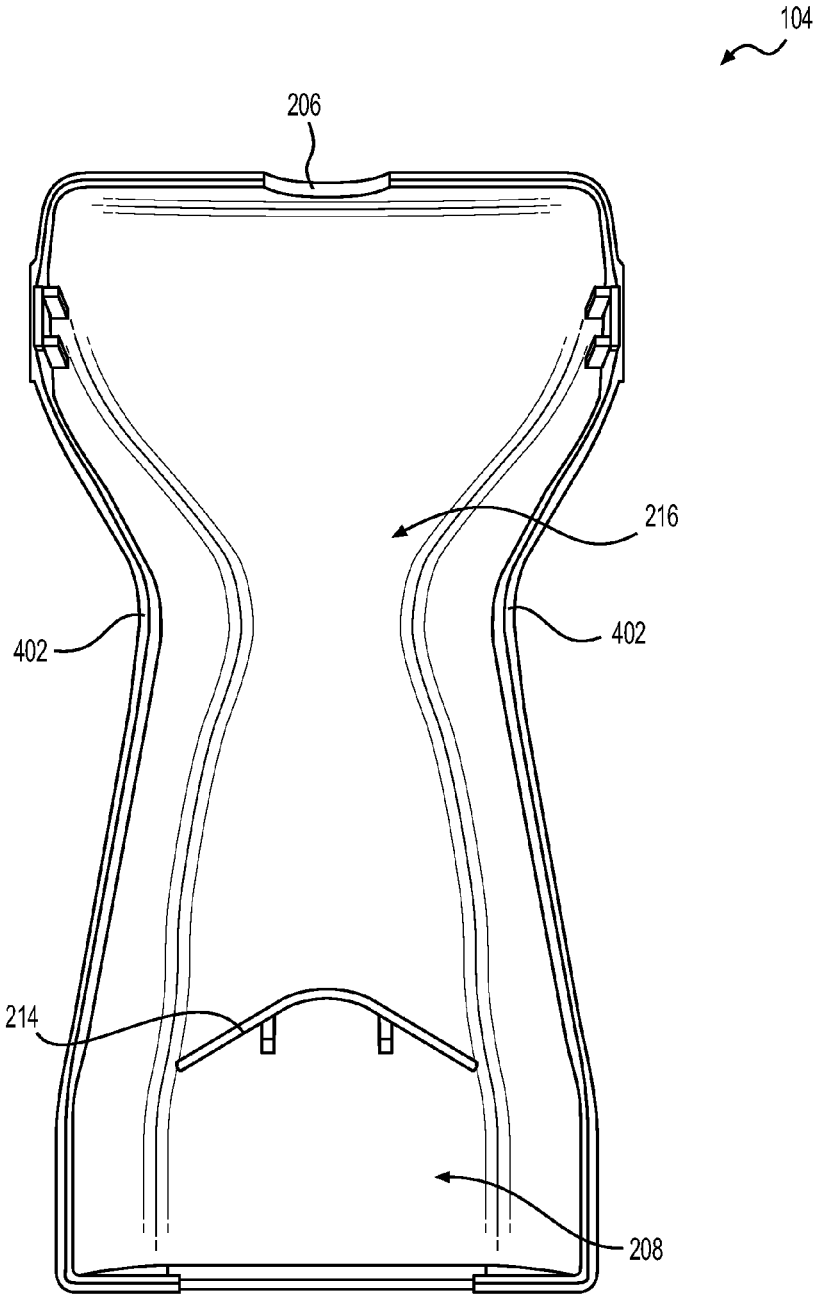
FIG. 4 illustrates the view of the interior of an embodiment of the back portion of the food pouch container disclosed herein.

FIG. 4 shows the front view of the back portion 104. The illustrated embodiment comprises a generally rectangular shape, with the addition of side pinches 402 at either side of the back portion 104. As can be seen from the illustrated embodiments of FIGS. 1-3, corresponding side pinches appear on the front portion 102 as well. The upper cavity 216, then is defined at the top by the top of the container 100, and the top opening 206; at the bottom by the surface 214; and at the sides by the sides of the container 100 having the side pinches 402. A food pouch is placed in the upper cavity 216 such that the bottom of the food pouch rests on the surface 214, and attains the generally curved shape of the surface 214. The nozzle of the food pouch protrudes from the top opening 206. The sides of the food pouch are also curved due to the curvature caused by the side pinches 402.

In some embodiments, the user can choose to store the cap of the food pouch in the lower cavity 208 while the child is consuming the food in the food pouch, thereby reducing the chances of the cap getting lost or dirty.

The inventors have discovered that when a food pouch is partially used, vacuum is generated at the top of the food pouch and the body of the pouch collapses. While there is still plenty of food within the pouch, a child cannot access it easily because of the collapsed body of the pouch near the nozzle. The child will then need to suck forcefully, which results in the tiring of, and aches in, the jaw. However, in some embodiments, when the food pouch is placed in the container 100 as described herein, where the food pouch attains the curvatures discussed above, there is created a "pinch" by the side pinches 402 and a "push" by the surface 214. Consequently, in these embodiments, the body of the pouch does not collapse and the child can easily access the entirety of the food in the pouch, without having to suck forcefully.

Figure 5A:
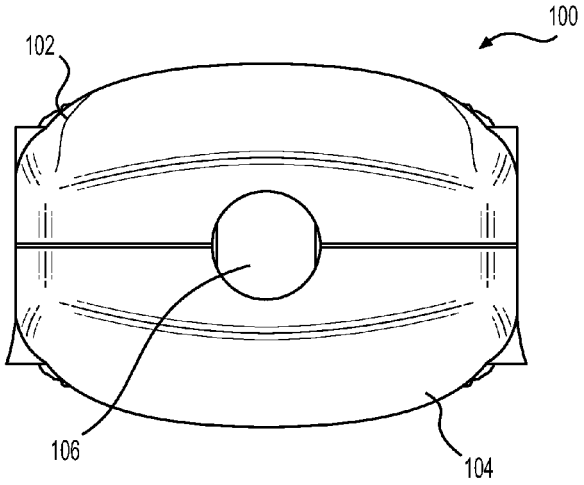
FIG. 5A illustrates the top view of an embodiment of the food pouch container disclosed herein in its closed configuration.
Figure 5B:
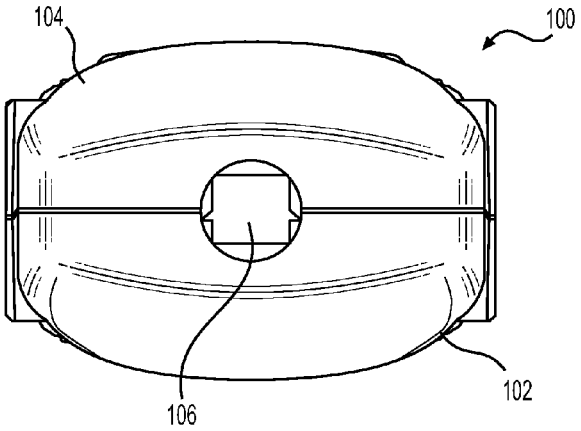
FIG. 5B illustrates the top view of another embodiment of the food pouch container disclosed herein in its closed configuration.

FIGS. 5A-B illustrate two embodiments of the top opening 106 of the container 100. In FIG. 5A, the top opening 106 is circular and is configured to accommodate a food pouch having any shape nozzle. However, the standard nozzle for the food pouches currently on the market has a square cross section. The embodiment of FIG. 5B has a square top opening 106. The advantage of this embodiment is that when the food pouch is placed in the container 100, the cap of the food pouch can be twisted open or closed without the need to hold the nozzle. In these embodiments, when the cap is twisted open or closed, the food pouch itself does not twist. When the food pouch twists, it can make it difficult to suck contents out of nozzle.

Figure 6A:
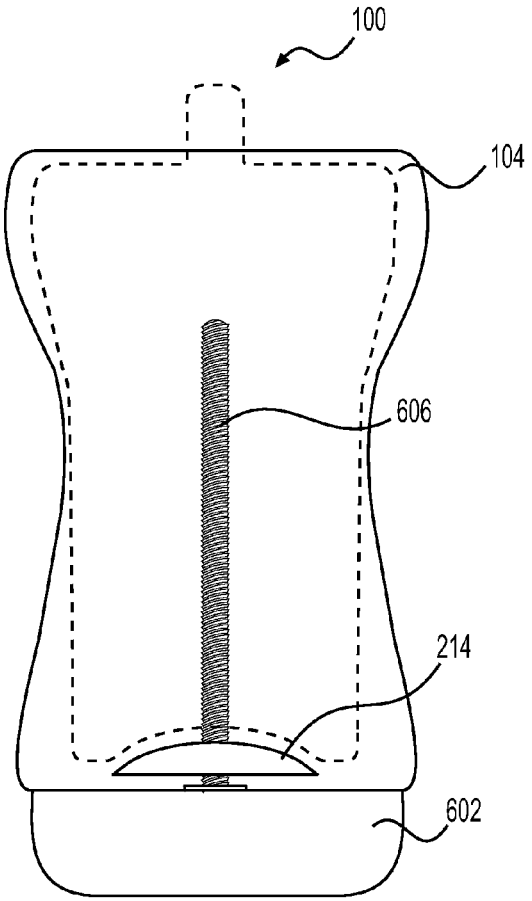
FIG. 6A illustrates the front view of the interior of an embodiment of the food pouch container disclosed herein, without the door or front portion.
Figure 6B:
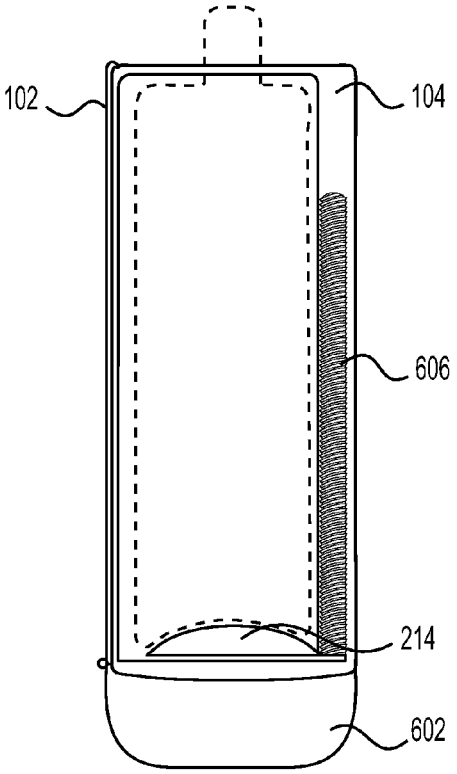
FIG. 6B illustrates the side view of the container shown in FIG. 6A in its closed configuration.

In other embodiments, the surface 214 is not fixed to the back portion 104. In these embodiments, there exists a mechanism by way of which the surface 214 is moved up or down. In some embodiments, for example the one shown in FIGS. 6A-B, an adjusting mechanism comprises a knob 602, a surface 214, and a threaded spindle 606. The threaded spindle 606 can be attached to or embedded in the interior of the back portion 104. The knob 602 is located outside of the container 100. The user can rotate the knob 602, thereby moving surface 214 up or down, providing more or less pressure on the food pouch (shown in broken line), as the need may be. Once the food pouch is used and prior to the insertion of a new food pouch, the user can rotate the knob 602 such that the surface 214 is back down to its bottommost location.

Figure 7:
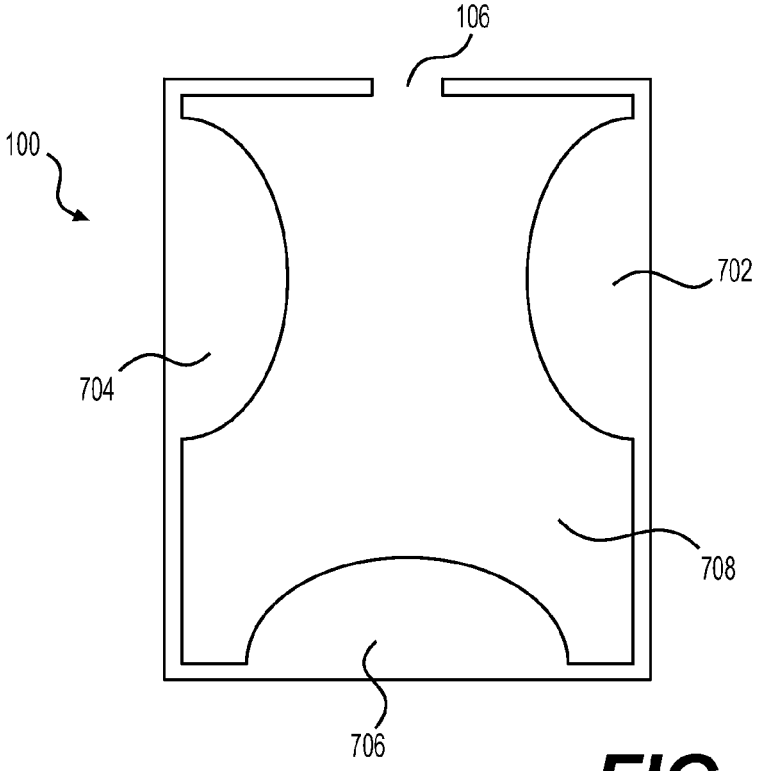
FIG. 7 illustrates the cross section of an embodiment of the food pouch container disclosed herein.

In yet another embodiment, shown in FIG. 7, there is provided a container 100 having phantom walls. When viewed from the outside, i.e., when the container 100 is closed, the container 100 has a generally rectangular shape. However, on the inside, there are solid curved side walls creating spaces 702,704 and a solid curved bottom creating space 706. The walls creating spaces 702,704 operate similarly as the side pinches 402, described above, while the bottom creating space 706 operates similarly as the surface 214, described above.

In some embodiments, the spaces 702,704 and/or bottom 706 are each independently hollow (see, for example, FIG. 11C, below), while in other embodiments, the spaces are each independently filled.

Figure 8:
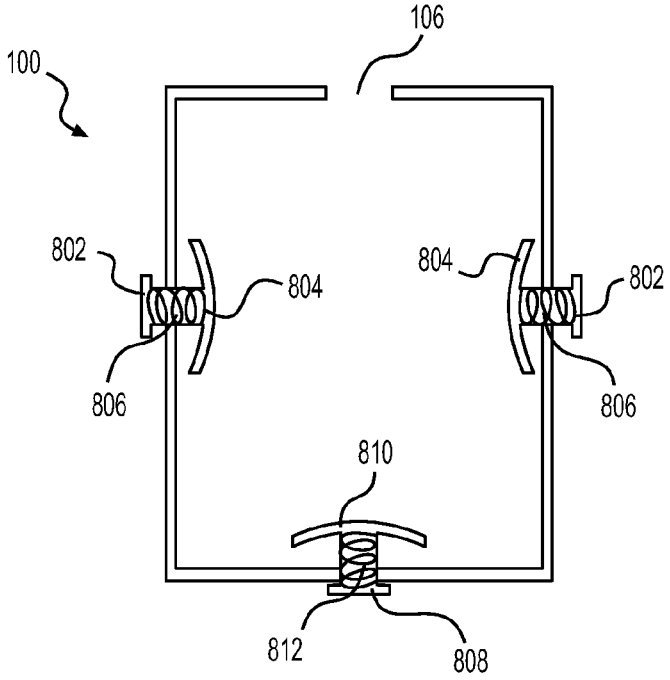
FIG. 8 illustrates the cross section of another embodiment of the food pouch container disclosed herein.

In still another embodiment, shown in FIG. 8, there is provided a container 100 having screwable pinches. One or more knobs 802 are placed at the side of the container 100. Each knob is connected to a pinch 804 via a threaded spindle 806. In some embodiments, the inward surface of the pinch 804 is flat, whereas in other embodiments, for example the one shown in FIG. 8, the inner surface of the pinch 804 is curved. When the knob 802 is turned, the pinch moves inward, providing side pressure to the food pouch. Similarly, there is provided a bottom knob 808, which is connected to a bottom pinch 810 via a threaded spindle 812. The turning of the knob 808 causes the bottom pinch 810 to move upward, providing bottom pressure to the food pouch. Prior to inserting a new food pouch, the user turns the pinches to their original, fully open position, giving the maximum cavity space. Some embodiments comprise only side pinches 804, while other embodiments comprise only the bottom pinch 810. Still other embodiments comprise one side pinch 804, while other embodiments comprise more than two side pinches 804 and/or two or more bottom pinches 810.

Figure 9A:
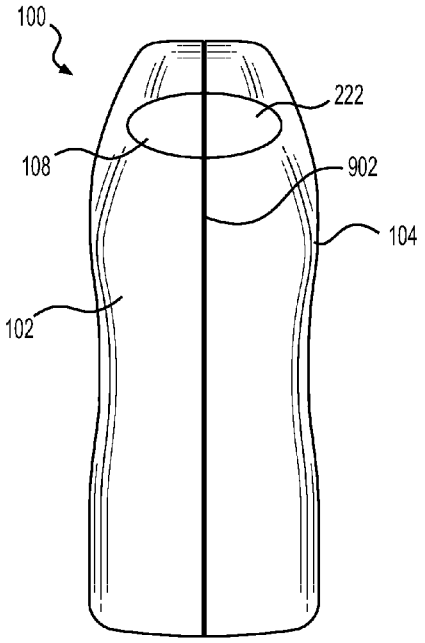
FIG. 9A illustrates the side view of an embodiment of the food pouch container disclosed herein in its closed configuration.
Figure 9B:
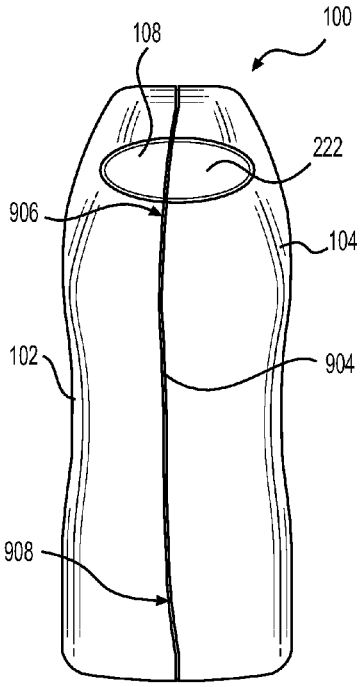
FIG. 9B illustrates the side view of another embodiment of the food pouch container disclosed herein in its closed configuration.

In some embodiments, the front portion 102 and the back portion 104 have the same proportions. In these embodiments, for example as shown in FIG. 9A, the centerline 902 is even. However, in some embodiments, the back portion 104 is slightly larger than the front portion 102, to provide a deeper cavity for the food pouch at the time of insertion, which makes the placement of the food pouch easier. An example of this embodiment is shown in FIG. 9B, where the centerline 904 is offset, as emphasized by the arrows 906 and 908. The offset centerline also provides for an easier means to close the container 100 when a food pouch is installed.

Figure 10A:
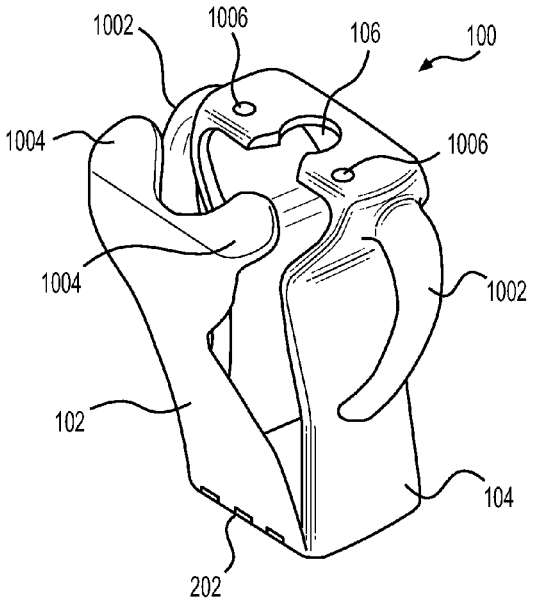
FIG. 10A illustrates the perspective view of an embodiment of the food pouch container disclosed herein, having handles, in its open configuration.
Figure 10B:
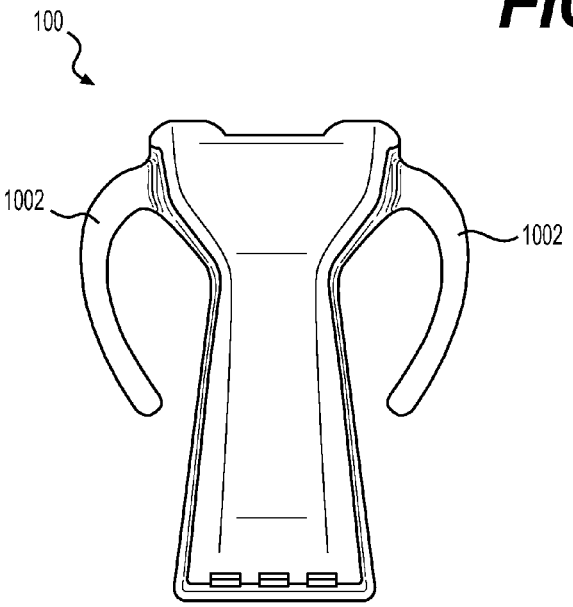
FIG. 10B illustrates the front view of an embodiment of the food pouch container disclosed herein, having handles, in its closed configuration.

In some embodiments, the container 100 disclosed herein comprises handles. An example of this embodiment is shown in FIGS. 10A-B. FIG. 10A shows a perspective view of the container 100, showing the front portion 102 partially separated from the back portion 104, while FIG. 10B shows a front view of this embodiment of the container 100. Handles 1002 allow the child to hold the container 100 while consuming the contents of the food pouch, without dropping the container 100.

FIG. 10A also illustrates another embodiment of a latch, which can be used with any of the embodiments of the container 100 disclosed herein. This embodiment comprises one or more latch mechanisms, each of which is an extension 1004 pointing towards the opposite portion of the container 100. For instance, if the extension 1004 is located on the front portion 102 of the container 100, as shown in FIG. 10A, then the extension 1004 points towards the back portion 104, and vice versa. The extension 1004 comprises at least one raised member (also referred to as a lip) (not shown). The portion opposite to the one having the extension 1004, for example the back portion 104 if the extension is on the front portion 102, comprises one or more indents 1006. When the front portion 102 and the back portion 104 are brought together in the closed configuration, the raised member of the extension 1004 forms a friction lock with the indent 1006. In some embodiments, for example the one shown in FIG. 10A, the raised member and the indent 1006 are circular. In other embodiments, they comprise a different cross section, for example a line, a rectangle, a square, a triangle, or another regular or irregular geometric shape. In some embodiments, the indent is on the extension 1004 and the raised member is on the opposite portion 104.

The embodiment shown in FIG. 10A does not have a surface 214. Instead only the side pinches 402 alone provide the necessary contour change to the food pouch. Thus, in some embodiments, the container 100 has a surface 214 without the side pinches 402, while in other embodiments, the container 100 has the side pinches 402 without a surface 214, and in still other embodiments, the container 100 has both the side pinches 402 and a surface 214.

While the embodiment of FIG. 10A shows a container 100 that has the handles 1002, the latch mechanism having extensions 1004 and indents 1006, and no surface 214, the skilled artisan recognizes that any of these features can be incorporated to any of the various embodiments of the container 100 disclosed herein. Thus, for example, the container 100 of FIG. 1, 5, 7, 8, 9, 11, or 12 can be made to have handles 1002, the latch mechanism having extensions 1004 and indents 1006, or no surface 214. And likewise, the embodiment of FIG. 10 can be made with no handles 1002, a latch mechanism other than one having extensions 1004 and indents 1006, or a surface 214.

FIGS. 11A-D show another embodiment of the container 100 disclosed herein. In some embodiments, for example the one shown in FIG. 11A, the front portion 102 is a cover, without having depth, and the back portion 104 comprises the entire depth of the container 100. In these embodiments, the food pouch is placed within the cavity of the back portion 104 and the front portion 102 closes shut to hold the food pouch within the container 100.

Figure 11A:
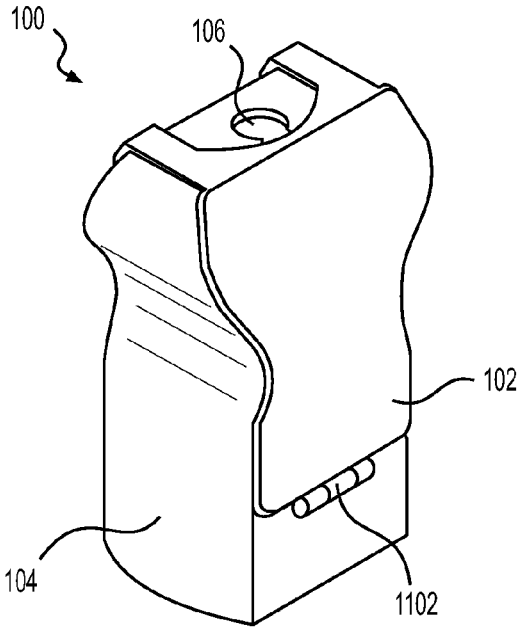
FIGS. 11A-11C illustrate an embodiment of the food pouch container disclosed herein in its closed configuration.
Figure 11B:
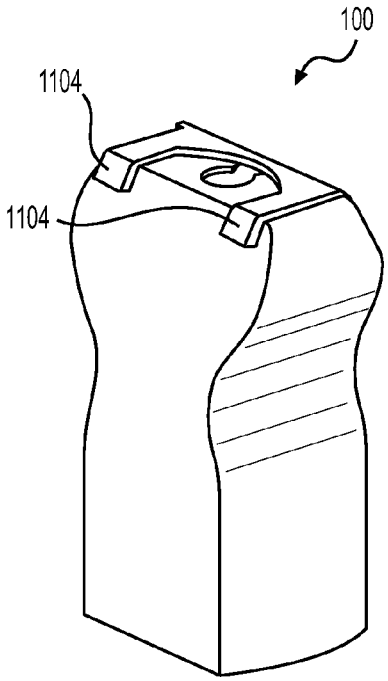

The embodiment of FIG. 11B shows latches 1104 that are external to the body of the container 100. In these embodiments, the downward distal end of the latch 1104 snaps on the reverse side of the back portion 104, resulting in securing the front portion 102 to the back portion 104. While this embodiment of a latch mechanism is disclosed in connection with the embodiment of FIG. 11, it is understood that this latch mechanism can be used with any of the presently disclosed containers 100.

Figure 11C:
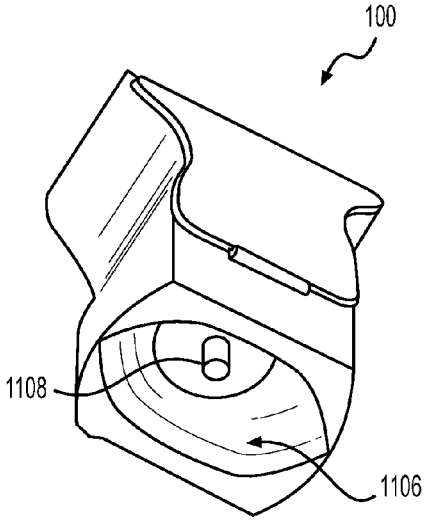

The embodiment of FIG. 11C is directed to a container 100 having a cap space 1106 at the bottom of the container 100. The cap space 1106 is a hollowed space into which the cap of the food pouch can be stored while the food pouch is opened for use. In some embodiments, for example that shown in FIG. 11C, a nubbin 1108 is present at the center of the cap space 1106, onto which the cap is threaded or snapped for a more secure hold.

Figure 11D:
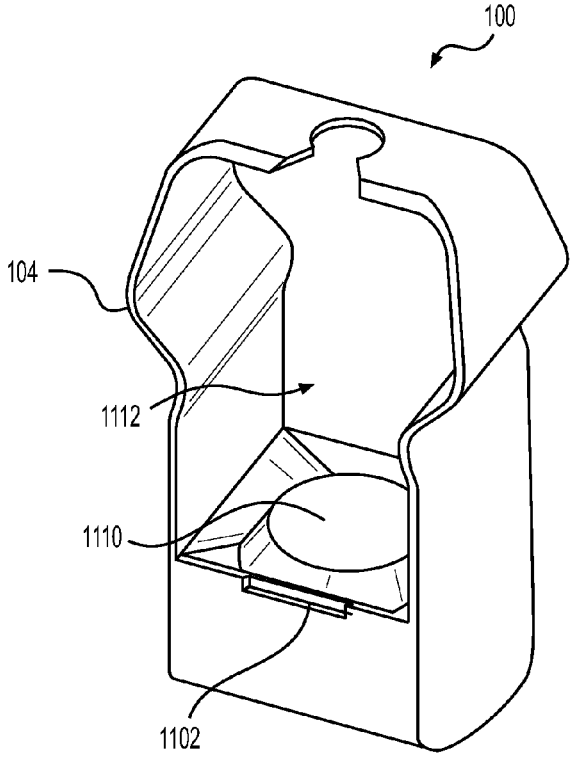
FIG. 11D illustrates the interior of the back portion thereof.

As shown in FIG. 11D, the cap space 1106 also causes a curved or raised surface 1110 to exist within the interior cavity of the container 100, for example similar to the curved top surface of the space 706, shown in FIG. 7. Surface 1110 serves a similar function as surface 214, shown in FIG. 3A. In this embodiment, the interior of the back portion comprises only one interior cavity, the upper cavity 1112, similar to the upper cavity 216 shown in FIG. 2. The lower cavity is an exterior cavity and is the cap space 1106. Thus, in some embodiments, the surface divides the back portion into an upper cavity and a lower cavity, where the lower cavity is on the exterior.

In some embodiments, for example the one shown in FIG. 11A, the hinge 1102 around which the front portion 102 separates from the back portion 104 is located at a point away from an edge of the container 100. For example, in FIG. 11A, the hinge 1102 is located approximately ⅕ of the way up from the bottom of the container 100. In certain embodiments, the hinge 1102 is located around the mid-section of the container 100.

In certain embodiments, the hinge 202, 1102 is on the side of the container 100. In some of these embodiments, the front portion 102 opens from the opposite side of the hinge 202, 1102. In other embodiments, the hinge 202, 1102 is on the back side. In some of these embodiments, when the front portion 102 separates from the back portion 104, the bottom of the container 100 will also rotate away.

Figure 12A:
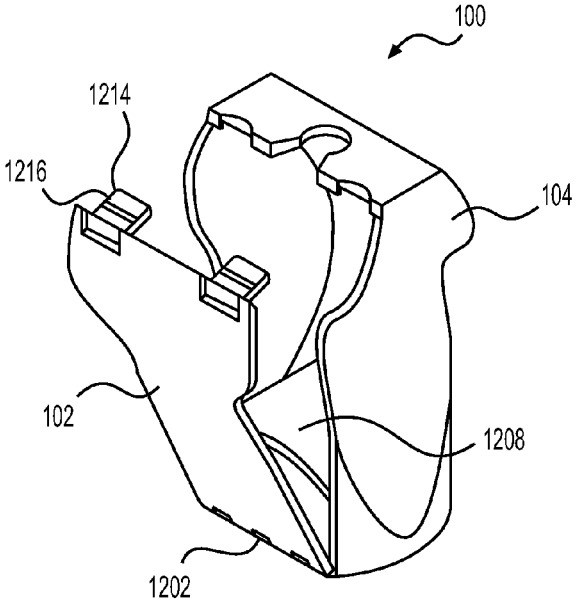
FIG. 12A illustrates an embodiment of the food pouch container disclosed herein in its open configuration.
Figure 12B:
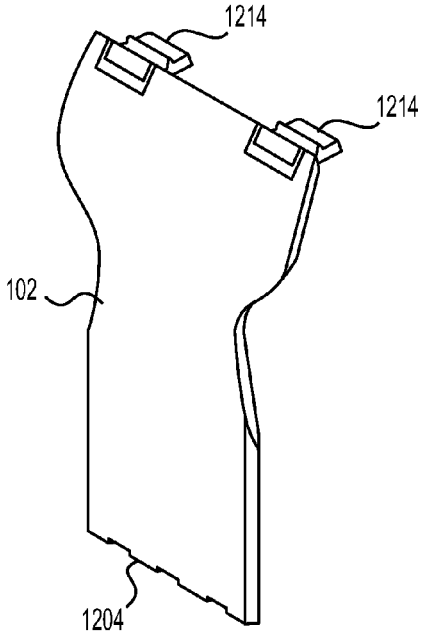
FIG. 12B illustrates the front portion and FIG. 12C illustrates the back portion thereof.
Figure 12C:
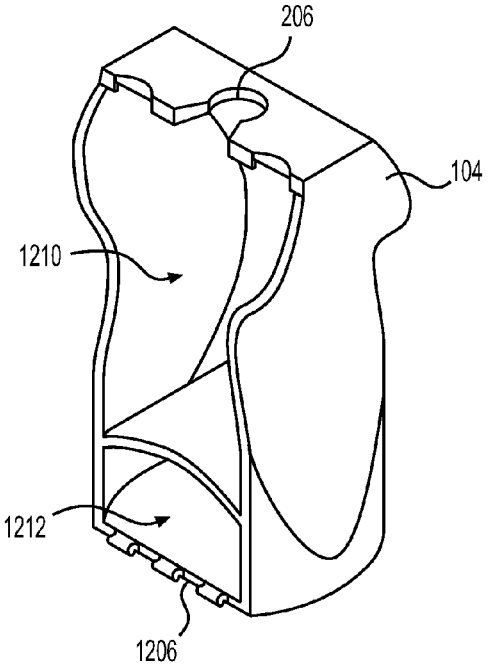

FIGS. 12A-12C illustrate another embodiment of the container 100. In this embodiment, the front portion 102, shown in FIG. 12B, has no depth. The entire depth of the container 100 is comprised in the back portion 104, shown in FIG. 12C. The hinge 1202 comprises two components: the front component 1204 located at the bottom of the front portion 102, and the back component 1206 located at the bottom front of the back portion 104. Thus, unlike the hinge 202 of the embodiment of FIG. 2, which is located in the middle area of the bottom of the container 100 when the container 100 is in its closed configuration, the hinge 1202 is located in the front of the bottom of the container 100 when the container 100 is in its closed configuration. A similar configuration can be applied to one or more embodiments of the container 100 disclosed herein.

The surface 1208 curves downward and traverses the entire width of the back portion 104. The surface 1208 divides the interior cavity of the back portion 104 into the upper cavity 1210 and the lower cavity 1212. Thus, while the surface 1208 acts similarly to the cantilever surface 214 of the embodiment of FIG. 2, it is different in that the surface 1208 is connected to the sides of the back portion 104. In some embodiments, the lower cavity 1212 is filled and the interior cavity only comprises the upper cavity 1210. In other embodiments, the lower cavity 1212 is external. A similar configuration can be applied to one or more embodiments of the container 100 disclosed herein.

In the embodiment shown in FIG. 12C, the top hole 206 is a semicircle defining an arc >180°. However, when the front portion 102 connects with the back portion 104 to close the container 100, the top hole 206 does not form a complete circle. Instead, the top hole 206 will comprise a straight edge formed by the front portion 102. This configuration makes it easier for a user to install the nozzle of the food pouch since the edge of the back portion 104 guides the nozzle into the semicircular part of the top hole 206. A similar configuration can be applied to any of the containers 100 disclosed herein.

The latch mechanism of the embodiment of FIG. 12 comprises at least one extension 1214, having at least one raised member (or lip) 1216. In the embodiment shown in FIG. 12, the extension 1214 is on the front portion 102, facing the back portion 104. Other embodiments, as discussed above, for example, with the extension being on the side or on the back portion, are also contemplated. A corresponding indent (not shown) on the opposite portion, for example the back portion 104, creates a friction lock between the back portion 104 and the front portion 102.

Figure 13B:
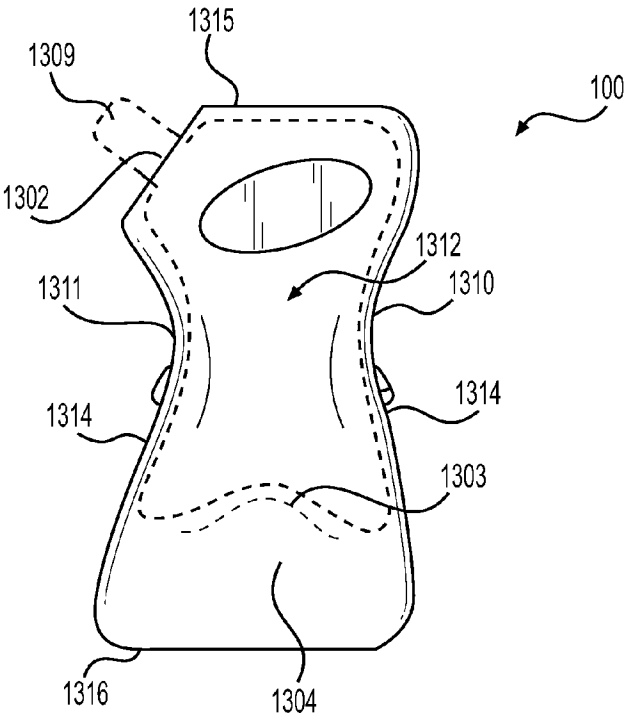
FIG. 13B illustrates the front view thereof.
Figure 13A:
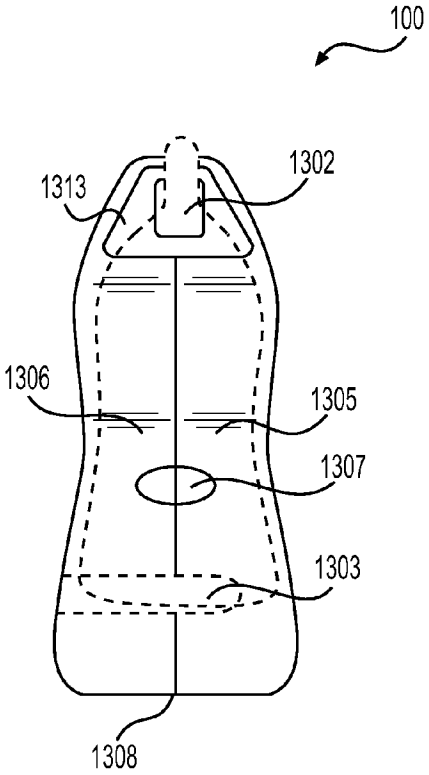
FIG. 13A illustrates an embodiment of the food pouch container disclosed herein in its closed configuration.

FIGS. 13A-B illustrate another food pouch container 100 which includes a body 1306. In some embodiments, the container 100 also includes a door 1305. Toward the top of container 100, door 1305 and body 1306 come together to form side face 1313. Side face 1313 contains orifice 1302, configured to receive a mouthpiece 1309 of the food pouch (shown in broken line). The cavity 1312 may be sealed by door 1305 that is moveably attached to the body 1306 of the container 100 by a hinge 1308 and configured to secure a food pouch within the body 1306 of container 100. In some embodiments, sealing of the door 1305 may be accomplished via an interlocking groove (not shown) formed in the perimeter of the door 1305. A latch 1307 or similar locking element may be provided to removably join the door 1305 to the body 1306. In some embodiments, the sidewalls 1314 may taper outward near the top face 1315 of container 100, then recede inwardly near the middle of container 100, and finally slope outwardly once again before terminating at the bottom face 1316 of container 100. The tapering of the sidewalls 1314 may form concave contour elements 1310 and 1311. The concave elements 1310,1311 may be configured to pinch or contour the food pouch in order to minimize the possibility of the formation of a vacuum seal upon emptying the contents of the pouch. Other features to prevent vacuum seal formation may be provided such as a cantilever 1303 that may extend from the body 1306. When the container 100 is closed, the cantilever 1303 may extend into the cavity of the door 1305 thereby creating a support for the bottom of the food pouch.

Figure 14B:
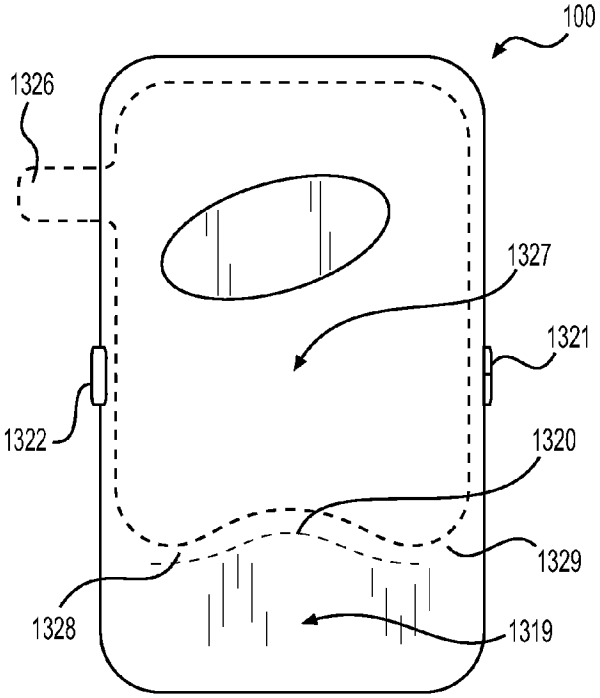
FIG. 14B illustrates the front view thereof.
Figure 14A:
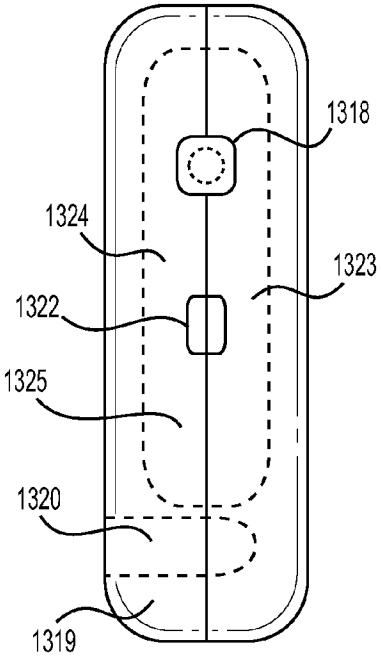
FIG. 14A illustrates an embodiment of the food pouch container disclosed herein, having a food pouch mouthpiece exiting a side, in its closed configuration.

FIGS. 14A-B illustrate another food pouch container 100 which includes a body 1324. In some embodiments, the container 100 also includes a door 1323. The container 100 includes a side face 1325, which is comprised of the sides of the body 1324 and the door 1323. In some embodiments, the side face 1325 may include an opening or orifice 1318, configured to receive a mouthpiece 1326 of a food pouch (shown in broken line). The cavity 1327 within the body 1324 is configured to hold the food pouch and may be sealed by door 1323 that is moveably attached to the body 1324 of the container 100 with a hinge 1321 or similar connecting element. In some embodiments, the door 1323 may have a latch 1322 to removably lock to the body 1324. In some embodiments, the body 1324 may also include a cantilever 1320. The cantilever 1320 of the body 1324 creates a second cavity 1319 that may be configured to hold a cap or top of a food pouch. The cantilever 1320 may also create concavities 1328 and 1329 within a lower portion of the cavity 1327 of the body 1324. The concavities 1328 and 1329 may be configured to hold the bottom corners of a food pouch. The overall shape of the container in its closed configuration could be that of a rectangular prism, a rounded rectangular prism, a trapezoidal prism, a rounded trapezoidal prism, or another shape.

Figure 15C:
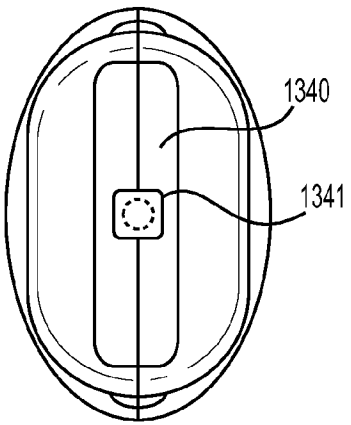
FIG. 15B illustrates the side view and FIG. 15C illustrates the top view thereof.
Figure 15B:
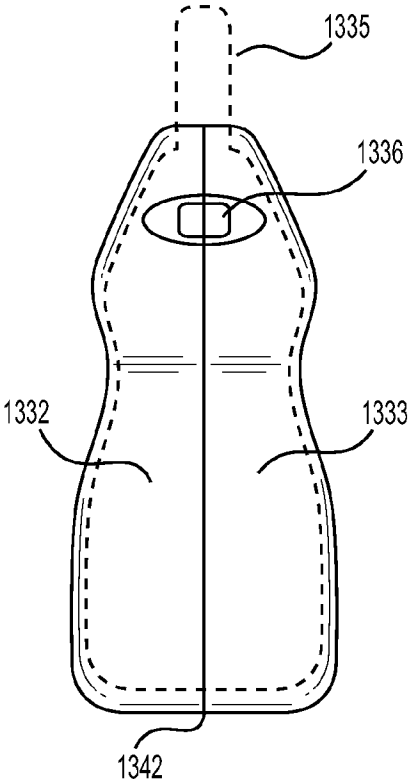
Figure 15A:
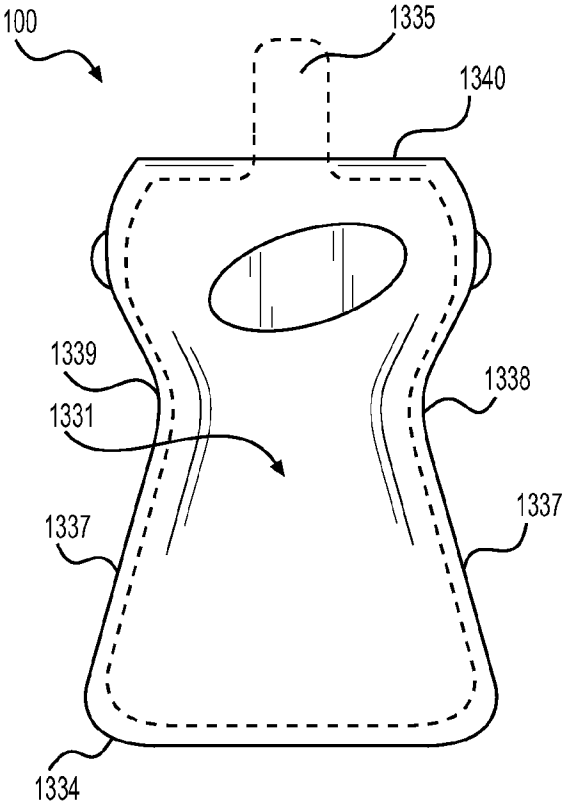
FIG. 15A illustrates an embodiment of the food pouch container disclosed herein in its closed configuration.

FIGS. 15A-C illustrate another food pouch container 100 which includes a body 1332. In some embodiments, the container 100 also includes a door 1333. The top face 1340, comprised of the upper portions of the body 1332 and the door 1333, includes an orifice 1341, which may be configured to receive the mouthpiece 1335 of the food pouch (shown in broken line). The cavity 1331 may be sealed by door 1333 that may be moveably attached to the body 1332 of the container 100 with a hinge 1342 and configured to secure, using a latch or locking element 1336, a food pouch within the body 1332 of container 100. The sidewalls 1337 taper outward near the top face 1340 of container 100, then recede inwardly near the middle of container 100, and finally slope outwardly once again before terminating at the bottom face 1334 of container 100. The tapering of the sidewalls 1337 form concave contour elements 1338 and 1339. In some embodiments, the concave elements 1338 and 1339 are configured to pinch or contour the food pouch in order to minimize the possibility of the formation of a vacuum seal. The user, such as a parent, may disengage the locking element 1336 and open door 1333 revealing cavity 1331 within the body 1332. The user then may load the food pouch directly into the body 1332. In some embodiments, the food pouch may be loaded with either the cap or top on or off. Orifice 1341 receives the mouthpiece 1335 of the food pouch. The door 1333, which may be moveably connected to the body 1332, can be closed and locked once the food pouch is secured within the body 1332. In some embodiments, once locked, the food pouch is secured such that the contents may be consumed via sucking action once the cap or top of the food pouch is removed. At the same time, the resilient side walls 1337 of the container 100 may prevent the contents of the food pouch from being squeezed out.

Figure 16C:
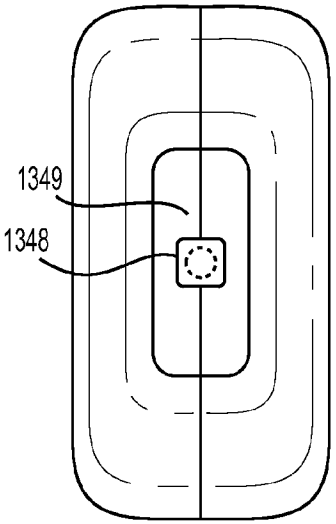
FIG. 16B illustrates the side view and FIG. 16C illustrates the top view thereof.
Figure 16B:
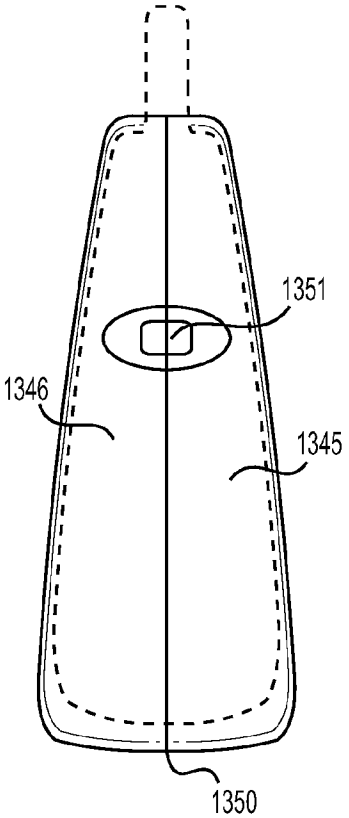
Figure 16A:
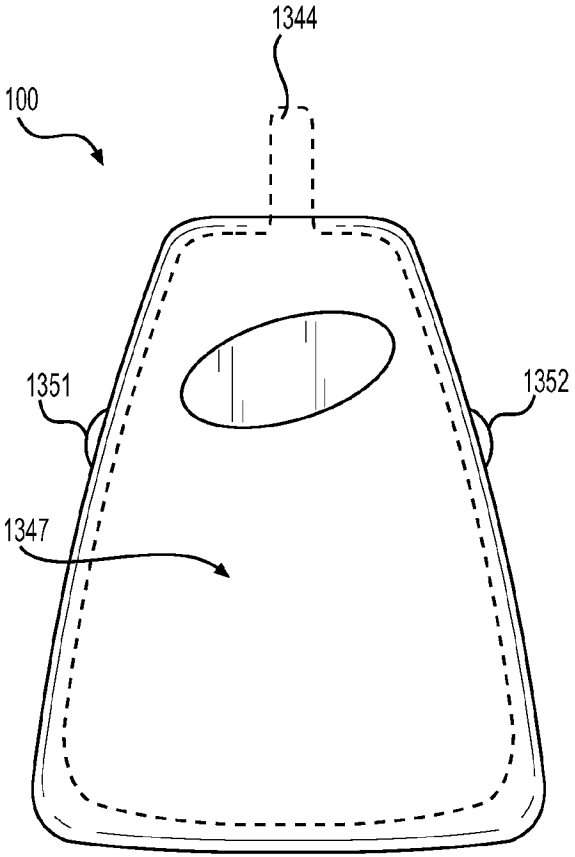
FIG. 16A illustrates an embodiment of the food pouch container disclosed herein in its closed configuration.
Figure 17C:
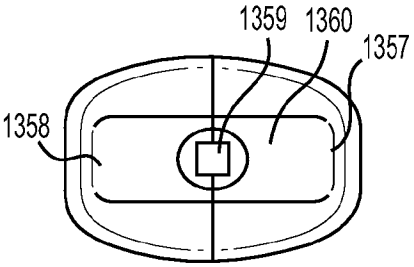
FIG. 17C illustrates the top view.
Figure 17D:
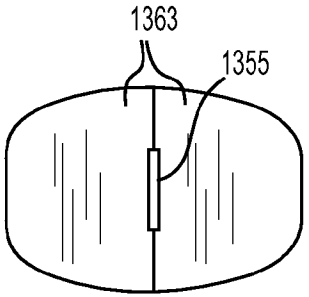
FIG. 17D illustrates the bottom view thereof.
Figure 17B:
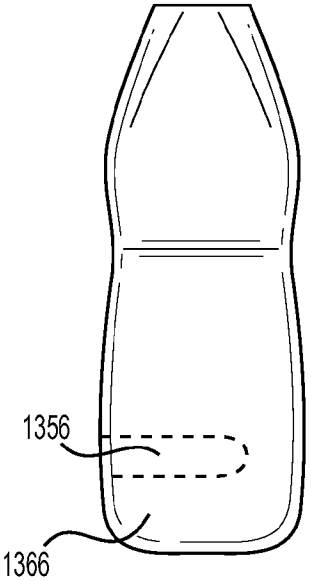
FIG. 17B illustrates the side view.
Figure 17A:
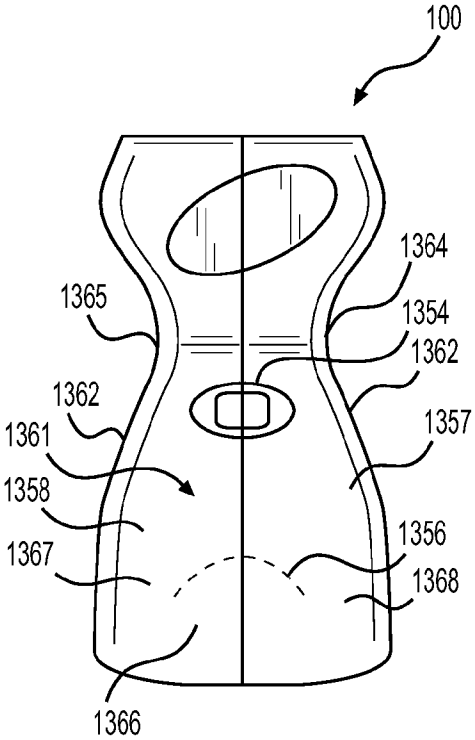
FIG. 17A illustrates an embodiment of the food pouch container disclosed herein in its closed configuration.

FIGS. 16A-C illustrate another food pouch container 100 which includes a body 1346. In some embodiments, the container 100 also includes a door 1345. The container 100 includes a top face 1349, which is comprised of the tops of the body 1346 and the door 1345. The top face 1349 includes an orifice 1348, configured to receive a mouthpiece 1344 of a food pouch (shown in broken line). In some embodiments, the cavity 1347 within the body 1346 may be configured to hold the food pouch and is sealed by door 1345, which may be moveably attached with a hinge 1350, to the body 1346 of the container 100. The user, such as a parent, may disengage the locking elements 1351 and 1352 and open door 1345 revealing cavity 1347 within the body 1346. The user then may load the food pouch directly into the body 1346. The food pouch may be loaded with either with the cap or top on or with the cap or top removed. Orifice 1348 receives the mouthpiece 1344 of the food pouch. In some embodiments, the door 1345, which may be moveably connected to the body 1346, can be closed and locked once the food pouch is secured within the body 1346. Once locked, the food pouch is secured such that the contents may be consumed via sucking action once the cap or top of the food pouch is removed. At the same time, the resilient material of the container 100 prevents the contents of the food pouch from being squeezed out. The overall shape of the container 100 in its closed configuration could be that of a rectangular prism, a rounded rectangular prism, a trapezoidal prism, a rounded trapezoidal prism, or another shape.

FIGS. 17A-D illustrate another food pouch container 100 which includes a right body 1357 and left body 1358. In some embodiments, the right body 1357 and left body 1358 may be referred to as a door or body. In some embodiments, the container 100 includes a top face 1360, which is comprised of the tops of the right body 1357 and the left body 1358. The top face 1360 includes an orifice 1359, configured to receive a mouthpiece of a food pouch (not shown). In some embodiments, the cavity 1361 within the container 100 may be configured to hold the food pouch and may be sealed when right body 1357 and left body 1358 are in a closed configuration. Right body 1357 and left body 1358 are moveably connected at a connecting element 1355, such as a hinge connection. The user, such as a parent, may disengage the locking element 1354, separate right body 1357 and left body 1358, revealing cavity 1361. The user then may load the food pouch directly into the container 100. The food pouch may be loaded with either the cap or top on or off. Orifice 1359 receives the mouthpiece of the food pouch. The right body 1357, which is moveably connected to the left body 1358, can be joined with the left body 1358 and locked once the food pouch is secured within the container 100. Once locked, the food pouch is secured such that the contents may be consumed via sucking action once the cap or top of the food pouch is removed. At the same time, the resilient material of the container 100 prevents the contents of the food pouch from being squeezed out. In some embodiments, the sidewalls 1362 taper outward near the top face 1360 of container 100, then recede inwardly near the middle of container 100, and finally slope outwardly once again before terminating at the bottom face 1363 of container 100. The tapering of the sidewalls 1362 forms concave contour elements 1364 and 1365. In some embodiments, the concave contour elements 1364 and 1365 are configured to pinch the food pouch in order to minimize the possibility of the formation of a vacuum seal. The container 100 also includes a cantilever 1356. The cantilever 1356, which may extend from the right body 1357 or left body 1358 of the container 100, creates a second cavity 1366 that may be configured to hold a cap or top of a food pouch. The cantilever 1356 also creates concavities 1367 and 1368 within a lower portion of the cavity 1361. In some embodiments, the concavities 1367 and 1368 may be configured to hold the bottom corners of a food pouch, which may help prevent the formation of vacuum seals that inhibit consumption of the contents of the food pouch.

Figure 18B:
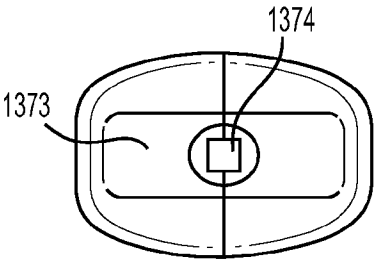
FIG. 18B illustrates the top view and FIG. 18C illustrates the bottom view thereof.
Figure 18C:
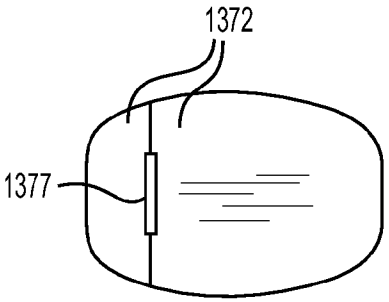
Figure 18A:
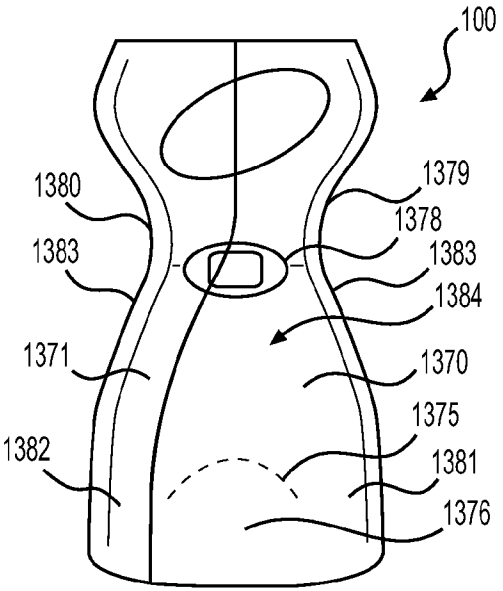
FIG. 18A illustrates an embodiment of the food pouch container disclosed herein in its closed configuration.

FIGS. 18A-C illustrate still another food pouch container 100 which includes a body 1370. The container 100 also includes a door 1371. In some embodiments, the container 100 includes a top face 1373, which may be composed of the tops of the body 1370 and the door 1371. In some embodiments, the top face 1373 includes an orifice 1374, which may be configured to receive a mouthpiece of a food pouch (not shown). The cavity 1384 within the body 1370 is configured to hold the food pouch and may be sealed by door 1371 that is moveably attached to the body 1370 of the container 100. The user, such as a parent, may disengage the locking element 1378, separating the body 1370 and the door 1371, revealing cavity 1384. The user then may load the food pouch directly into the container 100. The food pouch may be loaded with the cap or top on or with the cap or top removed. Orifice 1374 receives the mouthpiece of the food pouch. In some embodiments, the door 1371, which is moveably connected to the body 1370 using a hinge 1377, can be closed and locked once the food pouch is secured within the container 100. In some embodiments, locking may be provided with a locking element 1378, such as a clasp, hook, tang, and so forth. Once locked, the food pouch may be secured such that the contents may be consumed via sucking action once the cap or top of the food pouch is removed. At the same time, the resilient material of the sidewalls 1383 prevents the contents of the food pouch from being squeezed out. The sidewalls 1383 taper outward near the top face 1373 of container 100, then recede inwardly near the middle of container 100, and finally slope outwardly once again before terminating at the bottom face 1372 of container 100. The tapering of the sidewalls 1383 forms concave contour elements 1379 and 1380. In some embodiments, the concave contour elements 1379 and 1380 may be configured to pinch the food pouch in order to minimize the possibility of the formation of a vacuum seal. The body 1370 also includes a cantilever 1375, which creates a second cavity 1376, and may be configured to help hold a cap or top of a food pouch. In some embodiments, the cantilever 1375 may also create concavities 1381 and 1382 within a lower portion of the cavity 1384 of the body 1370. The concavities 1381 and 1382 may be configured to hold the bottom corners of a food pouch. In some embodiments, the generally vertical slice that splits the body 1370 and the door 1371 may be straight or may have a slight wave to it. This generally vertical slice originates at the top face 1373, dividing the top face 1373 into halves. The generally vertical slice may be configured to provide the cantilever 1375 within the body 1370 or the door 1371, and terminates at the bottom face 1372, thus dividing the bottom face 1372 into two symmetrical or asymmetrical parts.

Figure 19C:
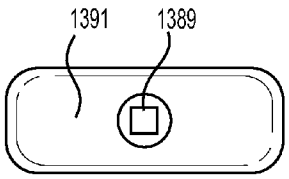
FIG. 19C illustrates the top view thereof.
Figure 19B:
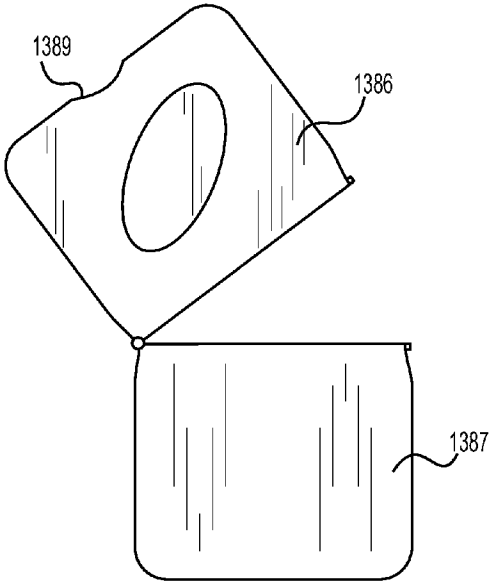
FIG. 19B illustrates the front view in its open configuration.
Figure 19A:
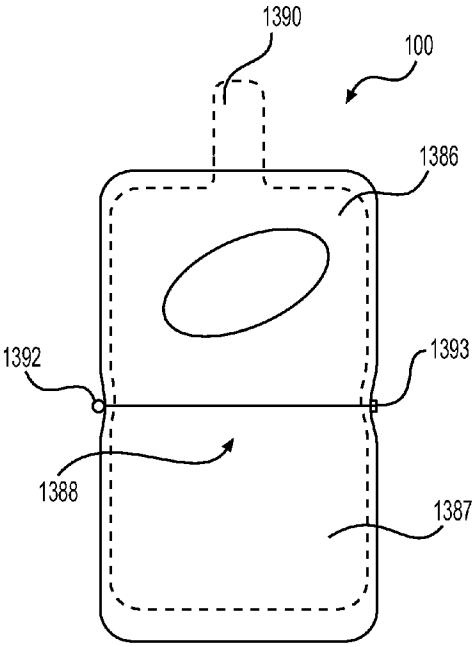
FIG. 19A illustrates the front view of an embodiment of the food pouch container disclosed herein in its closed configuration.

FIGS. 19A-C illustrate another food pouch container 100 which includes a body 1387. In some embodiments, the container 100 also includes a lid 1386. The container 100 includes a top face 1391, which is the upper part of lid 1386. The top face 1391 includes an orifice 1389, configured to receive a mouthpiece 1390 of a food pouch (shown in broken line). The cavity 1388 within the body 1387 and lid 1386 is configured to hold the food pouch and may be sealed by the lid 1386 that is moveably attached, using a hinge 1392, to the body 1387 of the container 100. The user, such as a parent, may disengage the locking element 1393, separating the body 1387 and the lid 1386, revealing cavity 1388. The user may then remove the cap or top from the food pouch and place the mouthpiece 1390 of the food pouch through orifice 1389. The user may then replace the cap or top of the food pouch and load the rest of the food pouch into the lower portion of cavity 1388 within the body 1387. The lid 1386, which is moveably connected to the body 1387, can be closed and locked once the food pouch is secured within the container 100. Once locked, the food pouch may be secured such that the contents may be consumed via sucking action once the cap or top of the food pouch is removed. At the same time, the resilient material of the container 100 prevents the contents of the food pouch from being squeezed out. The overall shape of the container 100 in its closed configuration could be that of a rectangular prism, a rounded rectangular prism, a trapezoidal prism, a rounded trapezoidal prism, or another shape.

Figure 20:
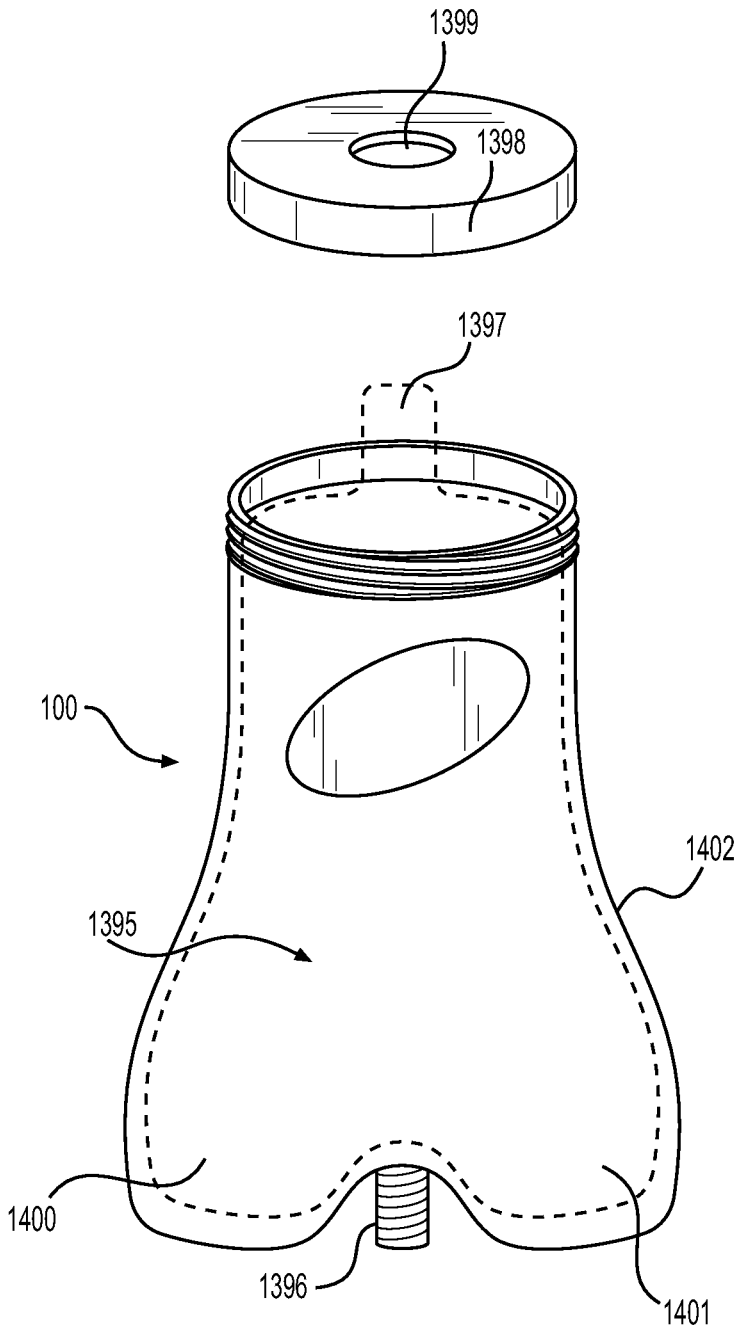
FIG. 20 illustrates the front view of an embodiment of the food pouch container disclosed herein in its open configuration.

FIG. 20 illustrates yet another food pouch container 100 which includes a body 1402 and a lid 1398. In some embodiments, the lid 1398 of container 100 includes an orifice 1399, configured to receive a mouthpiece 1397 of a food pouch (shown in broken line). The cavity 1395 within the body 1402 is configured to hold the food pouch and is sealed by the lid 1398 that may be attached to the body 1402 of the container 100 via a threaded connection. In certain embodiments, the threaded connection may be used to adjust or modulate pressure applied to the food pouch for continuing to ensure food pouch contents can be consumed. In some embodiments, the bottom of the body 1402 may comprise a nubbin 1396 that can be configured to temporarily store the top or cap of a food pouch. In order to temporarily store the top or cap of a food pouch, the nubbin 1396 may be threaded, have small protrusions for a snap-fit, or be tapered for an interference fit. The user, such as a parent, may remove the lid 1398, separating the body 1402 and the lid 1398, revealing cavity 1395. In some embodiments, the user then may then place the food pouch into cavity 1395 of the body 1402 of the container 100, such that the upper part of the food pouch that contains the mouthpiece 1397 is exposed. The user may then remove the cap or top from the food pouch, replace the lid 1398 thereby placing the mouthpiece 1397 of the food pouch through orifice 1399 of the lid 1398, and then secure the lid 1398 to the body 1402. Alternatively, lid 1398 may join with body 1402 via snapping means, friction fit, or the like. Once the lid 1398 is secured to the body 1402, the food pouch contents are secured such that they may be consumed via sucking action once the cap or top of the food pouch is removed. At the same time, the resilient material of the container 100 prevents the contents of the food pouch from being squeezed out. The body 1402 also contains concavities 1400 and 1401, which may be configured to hold the bottom corners of a food pouch, and which prevent the formation of vacuum seals which inhibit consumption of the contents of the food pouch. In some embodiments, the overall shape of the container 100 in its closed configuration may be that of an hour glass or other shape, however, the cavity 1395 is sized according to the food pouch type such that the shape of the cavity 1395 prevents the food pouch from collapsing while the contents of the food pouch are being emptied.

Figure 21:
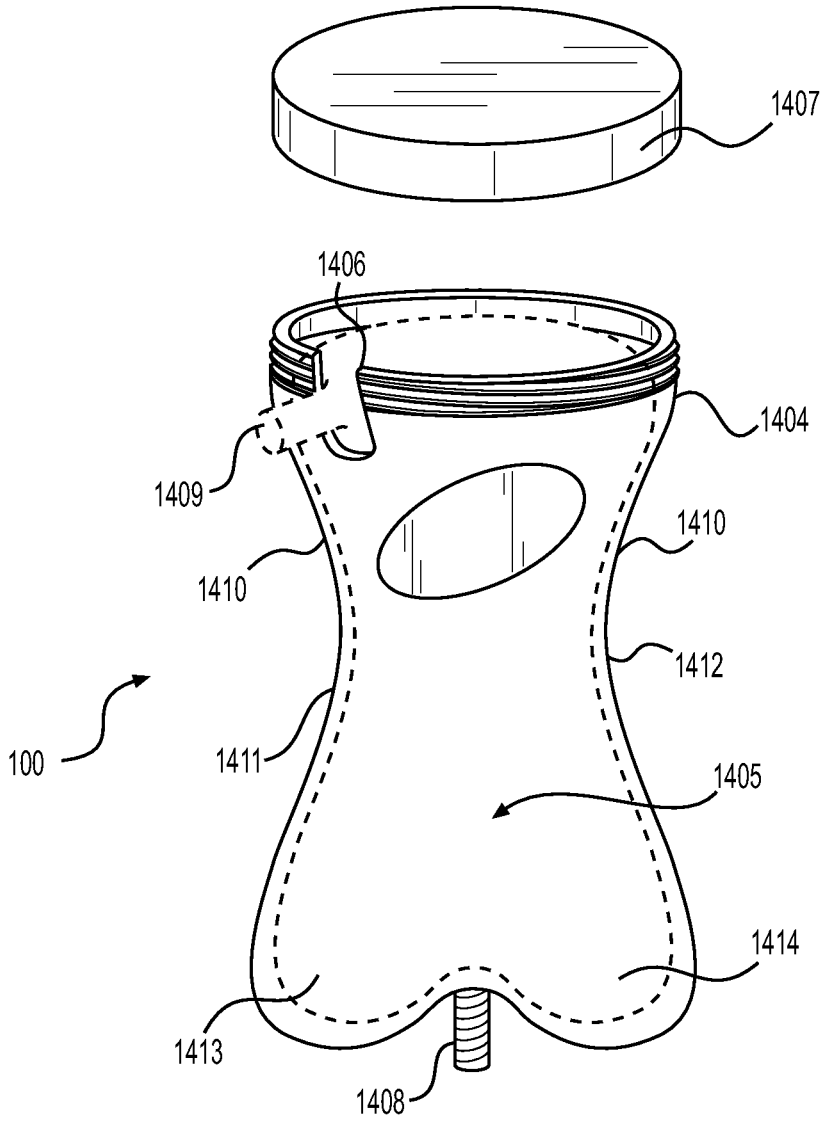
FIG. 21 illustrates the front perspective view of an embodiment of the food pouch container disclosed herein in its open configuration.

FIG. 21 illustrates another food pouch container 100 which includes a body 1404 and a lid 1407. In some embodiments, body 1404 also includes notch 1406, which can be configured to receive a mouthpiece 1409 of a food pouch (shown in broken line). The user, such as a parent, may unscrew the lid 1407, separating the body 1404 and the lid 1407, revealing cavity 1405. The user then may then place the food pouch into cavity 1405 of the body 1404 of the container 100, such that notch 1406 receives the mouthpiece 1409 of food pouch and the top of the food pouch is generally flush with the top of the body 1404. In some embodiments, the user may then remove the cap or top from the food pouch, and replace the lid 1407 securing the lid 1407 to the body 1404 via a threading action. While in other embodiments, lid 1407 may join with body 1404 via snap-fit, friction fit, compression fit, or the like. Once the lid 1407 is secured to the body 1404, the food pouch contents are secured such that they may be consumed via sucking action once the cap or top of the food pouch is removed. The body 1404 contains sidewalls 1410. The sidewalls 1410 taper outward near the top of container 100, then recede inwardly near the middle of container 100, and finally slope outwardly once again before terminating at the bottom of container 100. In some embodiments, the tapering of the sidewalls 1410 forms concave contour elements 1411 and 1412. The concave contour elements 1411 and 1412 are configured to pinch the food pouch in order to minimize the possibility of the formation of a vacuum seal. At the same time, the resilient material of the container 100 prevents the contents of the food pouch from being squeezed out. The body 1404 also contains concavities 1413 and 1414, which may be configured to hold the bottom corners of a food pouch, and which prevent the formation of vacuum seals which inhibit consumption of the contents of the food pouch. The bottom of the body 1404 may contain a nubbin 1408 that may be configured to hold the top or cap of a food pouch via threaded connection, snap-fit, interference fit, or other suitable connection.

Figure 22:
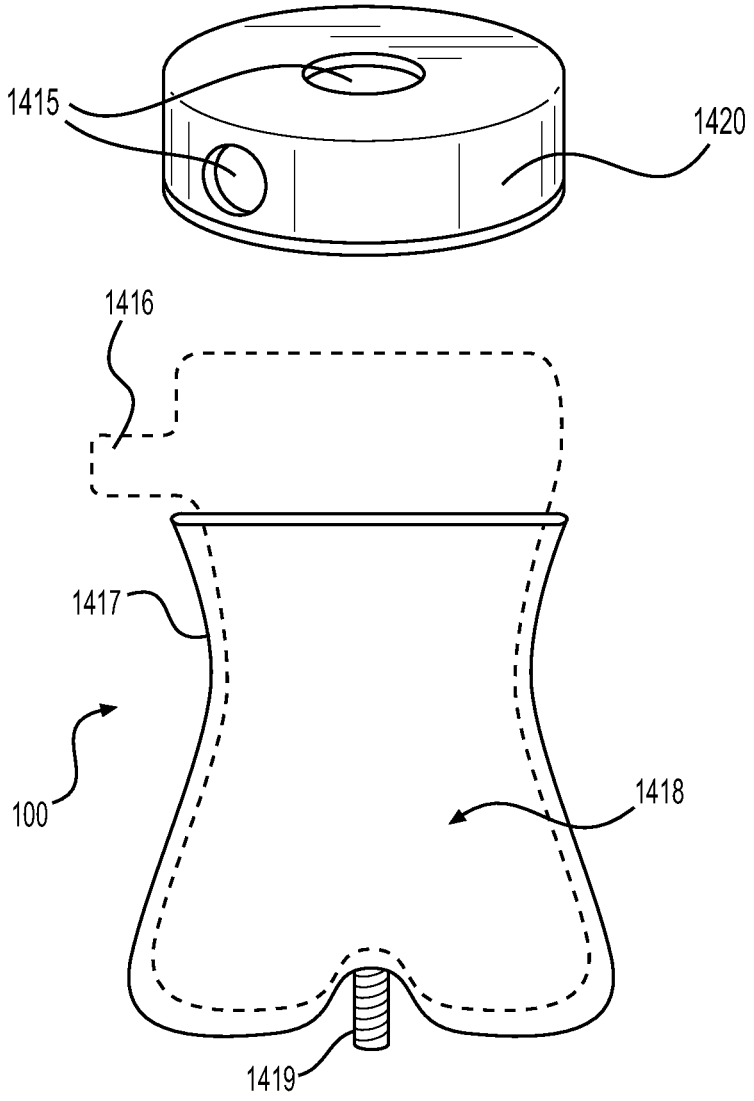
FIG. 22 illustrates the front perspective view of an embodiment of the food pouch container disclosed herein in its open configuration.

FIG. 22 illustrates another food pouch container 100 which includes a body 1417 and a lid 1420. Lid 1420 also includes orifices 1415, which may be configured to receive a mouthpiece 1416 of a food pouch (shown in broken line). In some embodiments, multiple orifices 1415 may be necessary because food pouches are manufactured having mouthpieces or nozzles in several possible orientations. The user, such as a parent, may remove the lid 1420, separating the body 1417 and the lid 1420, revealing cavity 1418. The user may then place the food pouch into cavity 1418 of the body 1417 of the container 100, such that the upper portion of food pouch that includes the mouthpiece 1416 is exposed above the top of the body 1417. The user may then remove the cap or top from the food pouch, replace the lid 1420, while simultaneously placing the mouthpiece 1416 of the food pouch through one of the orifices 1415, and then secure the lid 1420 to the body 1417 via snap fit or some other removable connection known to those skilled in the art. Once the lid 1420 is secured to the body 1417, the food pouch contents are secured such that they may be consumed via sucking action. The bottom of the body 1417 may contain a nubbin 1419 that can be configured to hold the top or cap of a food pouch via threaded connection, snap-fit, interference fit, or other suitable connection.

Figure 23C:
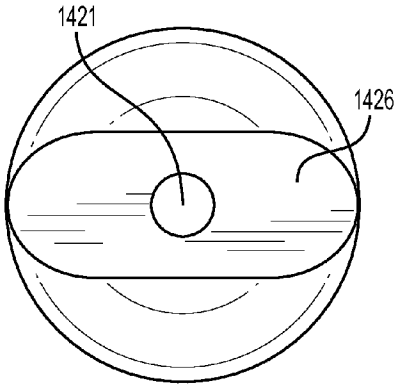
FIG. 23B illustrates the side perspective view and FIG. 23C illustrates the top view thereof.
Figure 23B:
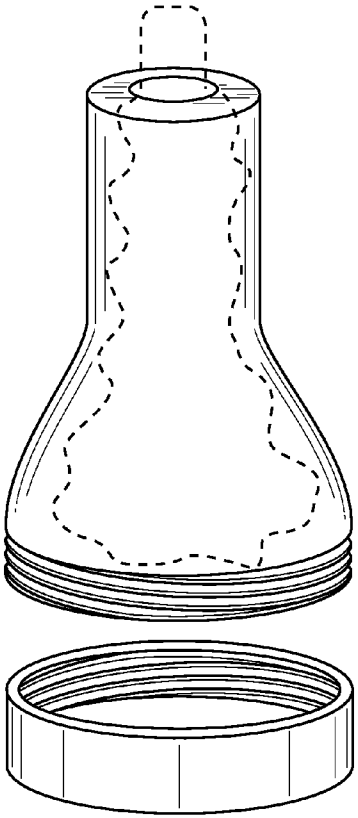
Figure 23A:
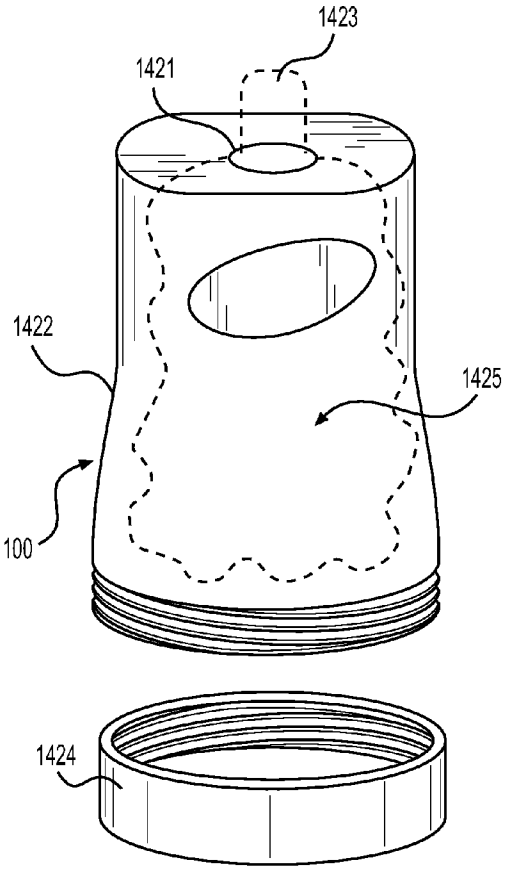
FIG. 23A illustrates the front perspective view of an embodiment of the food pouch container disclosed herein in its open configuration.

FIGS. 23A-C illustrate another food pouch container 100 which includes a body 1422. In some embodiments, the container 100 also includes a cover 1424. The body 1422 includes a top face 1426. In some embodiments, the top face 1426 includes orifice 1421, configured to receive a mouthpiece 1423 of a food pouch (shown in broken line). The user, such as a parent, may remove the cover 1424 by unscrewing it from the body 1422, separating the body 1422 and the cover 1424, revealing cavity 1425. The user may then remove the cap or top of the food pouch. The user may then place the food pouch into cavity 1425 of the body 1422 of the container 100, such that the orifice 1421 receives the mouthpiece 1423 of the food pouch and the mouthpiece 1423 protrudes beyond the top face 1426 of the body 1422 of the container 100. The user may then replace the cover 1424, by screwing it to the bottom of the body 1422. Alternatively, the cover 1424 could be connected to the body 1422 via snap fit, moveable connection such a hinge and latch, or some other connection. Once the cover 1424 is secured to the body 1422, the food pouch contents are secured in such that they may be consumed via sucking action. In some embodiments, the snug fit of the food pouch within the container 100 prevents the formation of vacuum seals which inhibit consumption of the contents of the food pouch.

Figure 24C:
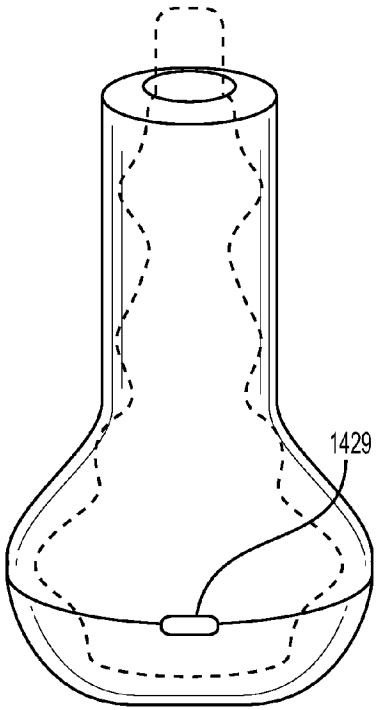
FIG. 24C illustrates the side view thereof.
Figure 24B:
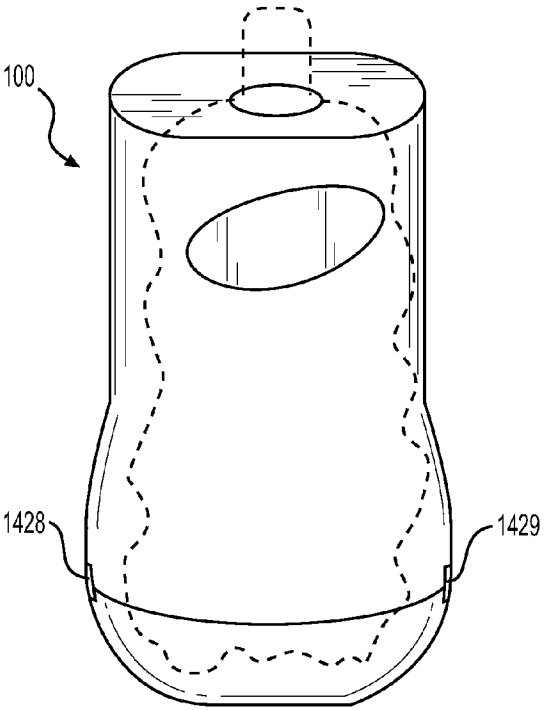
FIG. 24B illustrates the front view of the container its closed configuration.
Figure 24A:
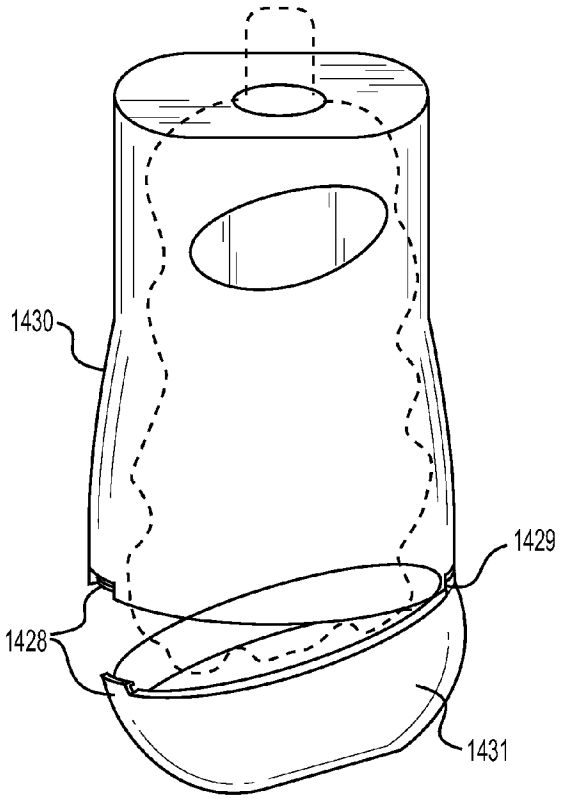
FIG. 24A illustrates a front perspective view of an embodiment of the food pouch container disclosed herein in its open configuration.

FIGS. 24A-C illustrate another food pouch container 100 which includes a body 1430 and a door 1431. FIGS. 24A-C are similar to FIGS. 23A-C, with the exception that door 1431 is movably connected to body 1430 at connecting element 1429, which may be a hinge. In some embodiments, door 1431 closes to secure the food pouch (shown in broken line) within the container 100 by engaging locking element 1428. The snug fit of the food pouch within the container 100 prevents the formation of vacuum seals which inhibit consumption of the contents of the food pouch.

Figure 25C:
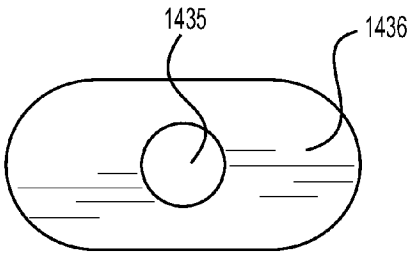
FIG. 25B illustrates the front perspective view of the container in its closed configuration and FIG. 25C illustrates the top view thereof.
Figure 25B:
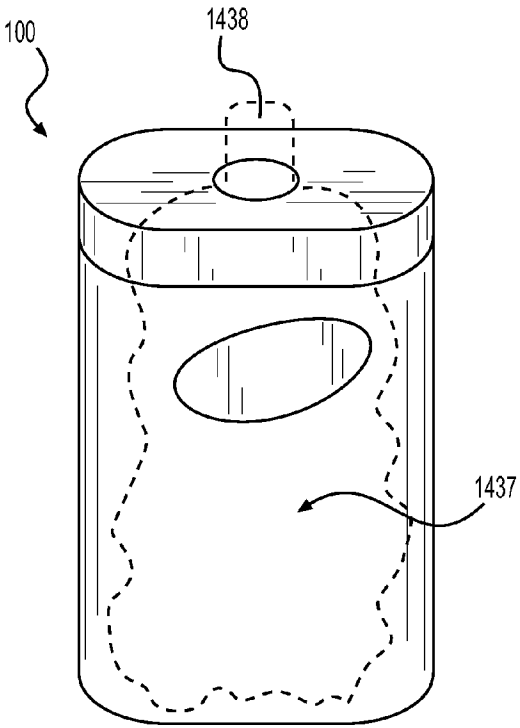
Figure 25A:
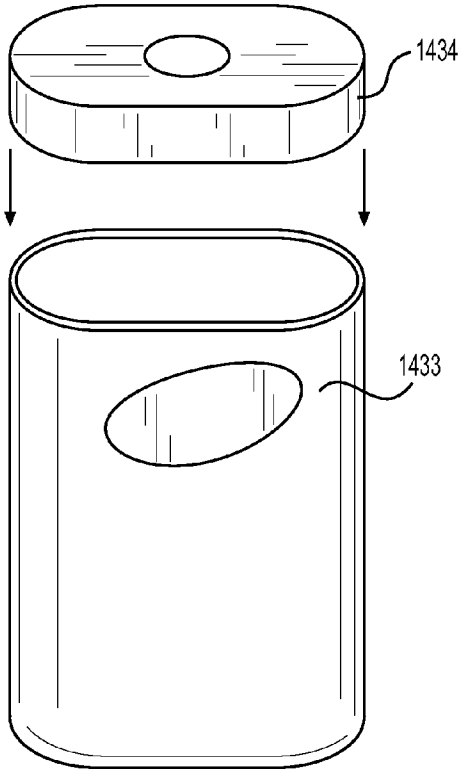
FIG. 25A illustrates the front perspective view of an embodiment of the food pouch container disclosed herein in its open configuration.

FIGS. 25A-C illustrate another food pouch container 100 which includes a body 1433. In some embodiments, the container 100 also includes a lid 1434. The lid 1434 includes a top face 1436. The top face 1436 includes orifice 1435, configured to receive a mouthpiece 1438 of a food pouch (shown in broken line). The lid 1434 may be removable via snap-fit connection, friction fit, compression fit, or the like. The user, such as a parent, may remove the lid 1434 from the body 1433, separating the body 1433 and the lid 1434, revealing cavity 1437. The user then may then place the food pouch into cavity 1437 of the body 1433 of the container 100. The user may then remove the cap or top of the food pouch. The user may then replace the lid 1434, seeing that orifice 1435 receives the mouthpiece 1438 of the food pouch, so that when container 100 is in a closed configuration, the mouthpiece 1438 protrudes beyond the top face 1436 of the lid 1434 of the container 100. Once the lid 1434 is secured to the body 1433, the food pouch contents are secured in such that they may be consumed via sucking action once the cap or top of the food pouch is removed. The snug fit of the food pouch within the container 100 prevents the formation of vacuum seals which inhibit consumption of the contents of the food pouch. In some embodiments, the overall shape of container 100 in its closed configuration could be that of an elliptical cylinder, a cylinder with bases that are generally oval, or a cone with its top cut off and with bases that are generally oval.

Figure 26C:
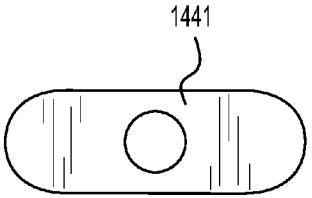
FIG. 26C illustrates the top view thereof.
Figure 26B:
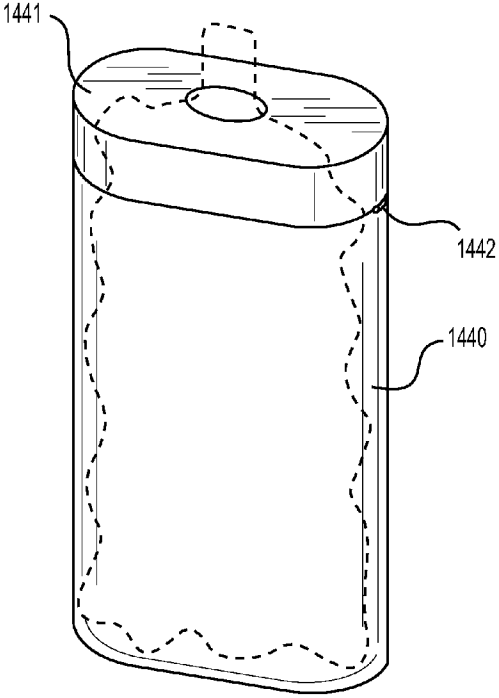
FIG. 26B illustrates a perspective view of the container its closed configuration.
Figure 26A:
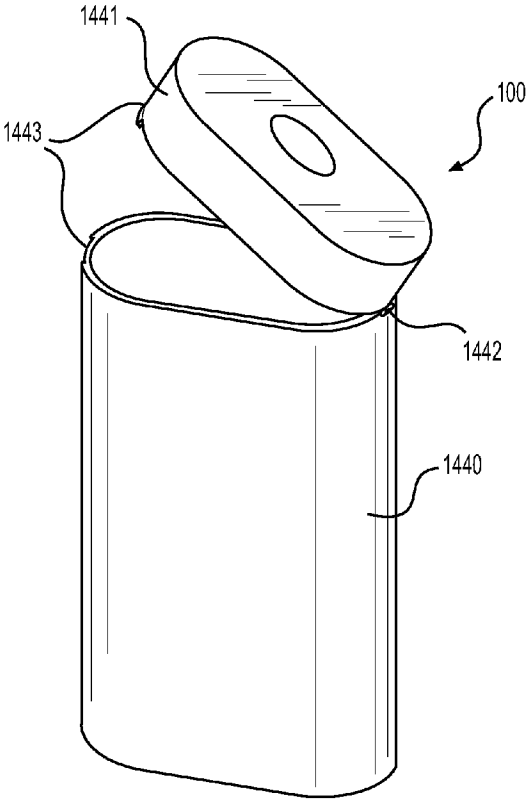
FIG. 26A illustrates a perspective view of an embodiment of the food pouch container disclosed herein in its open configuration.

FIGS. 26A-C illustrate another food pouch container 100 which includes a body 1440 and a lid 1441. Lid 1441 is movably connected to body 1440 at connecting element 1442, which may be a hinge. Lid 1441 closes to secure the food pouch within the container 100 by engaging locking element 1443. The snug fit of the food pouch (shown in broken line) within the container 100 prevents the formation of vacuum seals which inhibit consumption of the contents of the food pouch.

Figure 27B:
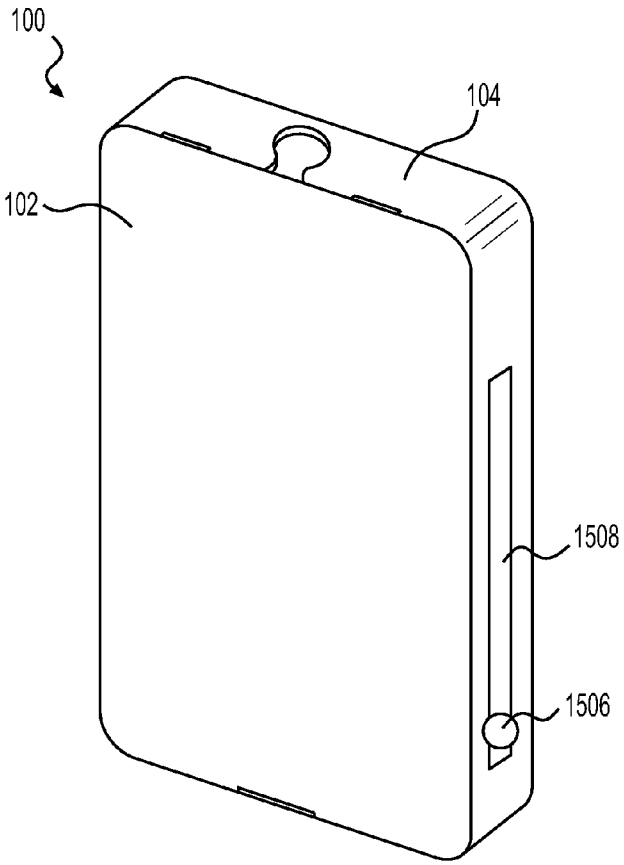
FIG. 27B illustrates a perspective view of the container shown in 27A in its closed configuration.
Figure 27A:
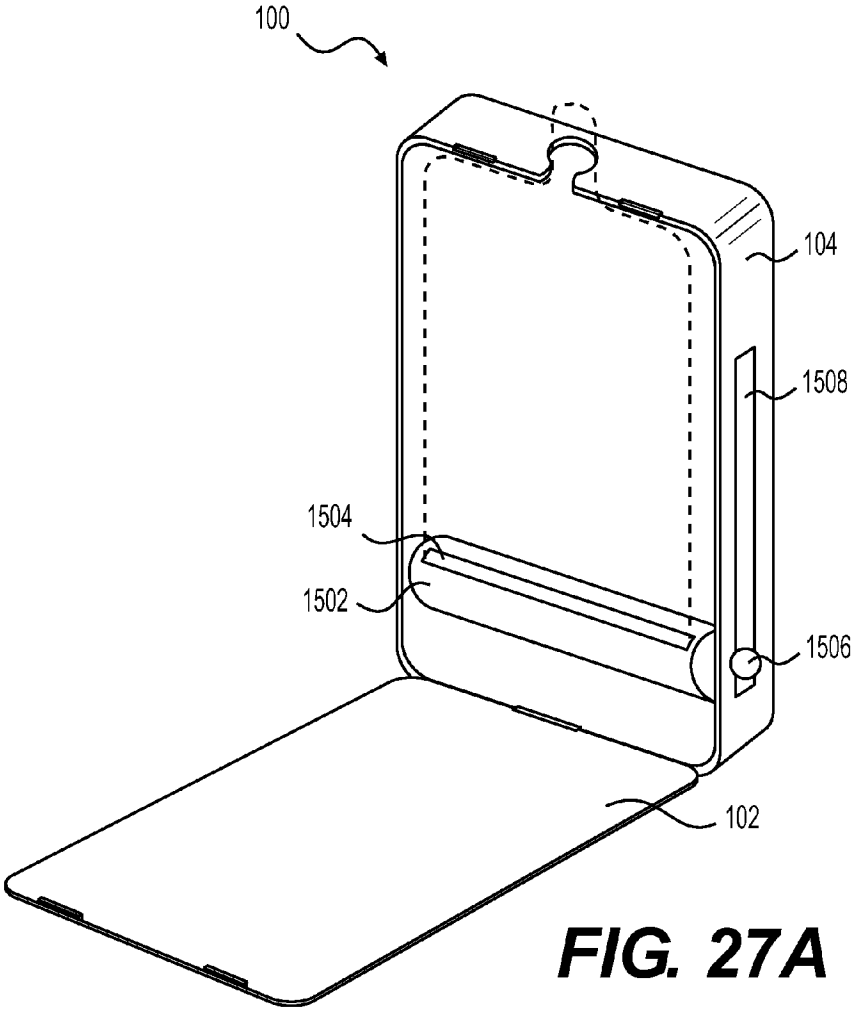
FIG. 27A illustrates a perspective view of an embodiment of the food pouch container disclosed herein in its open configuration.

In other embodiments, for example the one shown in FIGS. 27A-B, there is provided a roller 1502 inside of the container 100, the roller 1502 having a slot 1504 therein. In some embodiments, the roller 1502 is connected with at least one knob 1506, which is placed along a track 1508, at the side of back portion 104 of the container 100. The bottom of a food pouch is loaded into slot 1504. When the knob 1506 is turned, the roller 1502 turns, thereby rolling the food pouch (shown in broken line) from the bottom and squeezing the food out of the food pouch. This action is similar to rolling a toothpaste tube from the bottom.

Figure 28B:
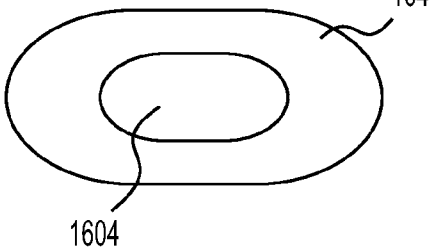
FIG. 28B illustrates the bottom view thereof.
Figure 28A:
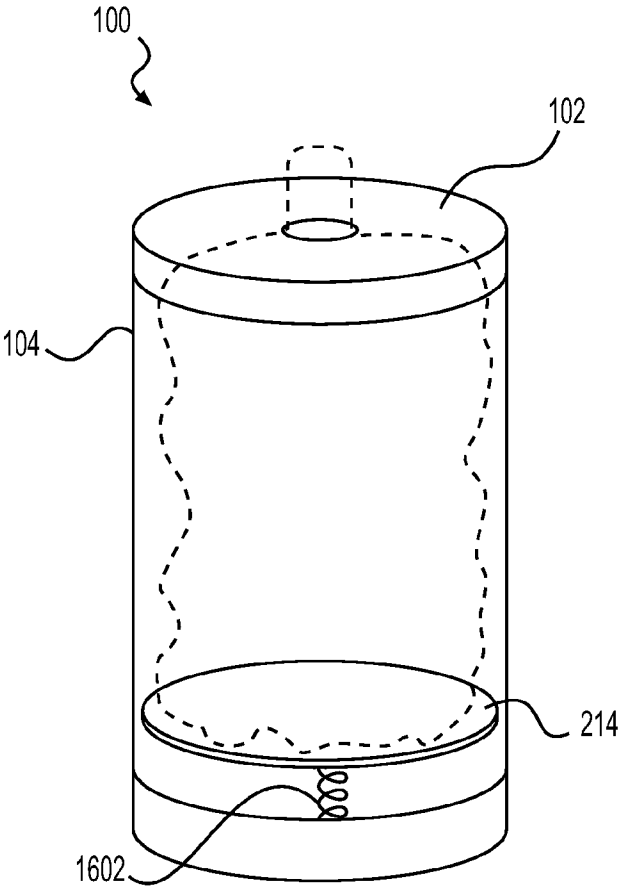
FIG. 28A illustrates a perspective view of an embodiment of the food pouch container disclosed herein in its closed configuration.

In other embodiments, for example the one shown in FIGS. 28A-B, there is provided a boss 1604 at the bottom of container 100, which is in contact with a surface 214 via a spring 1602. When the user pushes the boss 1604 in, towards the top of the container 100, the surface 214 also moves upward providing additional pressure on the food pouch (shown in broken line). Once the food pouch is used and prior to the insertion of a new food pouch, the user moves the surface 214 back down to its bottommost location.

In some embodiments (not shown), the body of the container 100 comprises an outer shell and an inner shell, with a lining space there between. In some embodiments, the lining space is filled with air. Air is a known insulator. In these embodiments, the contents of food pouch retain their temperature for a longer period of time than if a single shell container 100 is used.

In some embodiments, the lining space is filled with a heatable and/or coolable fluid, for example a liquid or a gel. The user can heat the container 100, for example by placing the container 100 in a microwave oven or warm water, thereby heating the fluid. In some embodiments, the fluid has a high specific heat, and therefore, loses its heat slowly. The heated fluid can then either heat the contents of the food pouch, or help in keeping the contents of a pre-heated food pouch warm.

Similarly, if the fluid is coolable, or also coolable, the user can place the food pouch in a refrigerator, freezer, or cold water, thereby cooling the fluid. In some embodiments, the fluid has a high specific heat, and therefore, warms up slowly. The cooled fluid can then either cool the contents of the food pouch, or help in keeping the contents of a pre-cooled food pouch cool. In some embodiments, the fluid is freezable.

While in some embodiments the food pouch is first inserted into the back portion 104 and then the front portion 102 is latched to close the container 100, in other embodiments, the food pouch is first inserted into the front portion 102 first and then the back portion 104 is latched to close the container 100.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. A food pouch container comprising:

a body having an interior cavity, wherein the body has a base, sidewalls extending upwardly from the base and a top panel;

the interior cavity being sized and shaped to enclose at least a flexible portion of a food pouch;

a door;

a hole, said hole extending through the top panel and being sized and shaped to closely surround a neck of a mouthpiece of the food pouch;

at least one side pinch; and a surface dividing the interior cavity of the body into an upper cavity and a lower cavity.

2. The container of claim 1, wherein the body and the door are attached via a hinge.

3. The container of claim 2, wherein the hinge is at a location selected from the group consisting of a side of the container opposite of the hole, a side of the container 90° from the hole, and partway up from the bottom of the body.

4. The container of claim 1, further comprising at least one latch configured to releasably lock the door and the body together when the container is in a closed configuration.

5. The container of claim 4, wherein the latch is at a location selected from the group consisting of a bottom of the body, a top of the body, a side of the body, a bottom of the door, a top of the door, and a side of the door.

6. The container of claim 4, wherein one of the door or the body comprises a raised member while the other of the door or the body comprises an indent, wherein when the container is closed, the raised member catches the indent and causes the door and the body to remain connected.

7. The container of claim 1, wherein the surface is in a fixed position on the body.

8. The container of claim 1, wherein the surface is configured to be manually moved.

9. The container of claim 1, wherein the surface is flat.

10. The container of claim 1, wherein the surface is curved downward.

11. The container of claim 1, wherein the surface contours a bottom of the food pouch.

12. The container of claim 1, wherein the at least one side pinch is in a fixed position.

13. The container of claim 1, wherein the at least one side pinch is configured to be manually moved into or out of an upper cavity of the body.

14. The container of claim 1, wherein the body or the door comprises at least one curved side to create the at least one pinch.

15. The container of claim 1, wherein the at least one side pinch is a false wall.

16. The container of claim 1, wherein the container comprises at least one handle.

17. The container of claim 1, wherein a lower cavity of the body is configured to receive a separated cap of a food pouch.

18. The container of claim 1, comprising a side pinch on each side.

19. The food pouch container of claim 1, further comprising a surface for contouring a food pouch from a bottom thereof.

20. The container of claim 1 for a food pouch, the food pouch having a flat shape for holding soft food, the pouch further having a removable cap for the mouthpiece, wherein the container comprises:

a substantially rigid body;

the body being contoured to change the pouch to a bulbous shape, thereby enabling the soft food to be more easily emptied out of the pouch.

21. The container of claim 20, wherein the body contours the sides of the pouch.

22. The container of claim 20, further comprising an elevated surface that is curved downward.

23. The container of claim 20, wherein the body further comprises a perimeter groove.

24. The container of claim 20, wherein the body further comprises at least one latch configured to releasably lock the body and the door together when the container is in a closed configuration.

25. The container of claim 20, wherein the body threadably receives the door.

26. The container of claim 20, wherein the door is attached to the body via a hinge.

27. The container of claim 20, wherein the door modulates pressure applied to the pouch.

28. A food pouch container comprising:

a back portion having an interior cavity and a first perimeter groove;

a front portion with a second perimeter groove;

a top hole;

at least one side pinch for preventing a food pouch from collapsing while its contents are being emptied; and a cantilever extending from the back portion into the front portion, thereby dividing the interior cavity of the food pouch container into an upper cavity and a lower cavity, wherein the back portion and the front portion are attached via a hinge at the bottom of the container, and wherein the first and second perimeter grooves interlock upon closing the container.

29. The container of claim 28, wherein the back portion and the front portion each comprises a semicircle portion cut therein, wherein when the back portion and the front portion join together to form the container, the two semicircles form the top hole.

30. The container of claim 28, wherein the top hole is in the shape of a square or a rectangle.

31. The container of claim 28, further comprising at least one latch configured to releasably lock the front portion and the back portion together when the container is in a closed configuration.

32. The container of claim 31, wherein:

the back portion comprises two latches, located at either side of the top of the back portion;

each latch comprises a raised member; and the front portion comprises two indents;

wherein when the container is closed, the lip of the latch catches inside the indent and causes the front portion and the back portion to remain connected.

33. The container of claim 28, wherein the cantilever is curved downward.

34. The container of claim 28, wherein the at least one side pinch is in a fixed position.

35. The container of claim 28, wherein the back portion or the front portion comprises at least one curved side to create the at least one pinch.

36. The container of claim 28, wherein the lower cavity of the back portion is inside the back portion.

37. The container of claim 28, wherein the lower cavity of the back portion is configured to receive a separated cap of a food pouch.

38. The container of claim 28, wherein the container comprises two side pinches, one on each side of the container.

* * * * *